US011820146B2

(12) United States Patent
Uchiyama et al.

(10) Patent No.: US 11,820,146 B2
(45) Date of Patent: Nov. 21, 2023

(54) WASTE LIQUID CONTAINER

(71) Applicant: SEIKO EPSON CORPORATION, Tokyo (JP)

(72) Inventors: Masaki Uchiyama, Azumino (JP); Toshio Nakata, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 105 days.

(21) Appl. No.: 17/465,641

(22) Filed: Sep. 2, 2021

(65) Prior Publication Data

US 2022/0080737 A1 Mar. 17, 2022

(30) Foreign Application Priority Data

Sep. 11, 2020 (JP) ..... 2020-152848

(51) Int. Cl.
*B41J 2/165* (2006.01)
*B41J 2/17* (2006.01)

(52) U.S. Cl.
CPC ..... *B41J 2/16523* (2013.01); *B41J 2/1721* (2013.01); *B41J 2002/1728* (2013.01)

(58) Field of Classification Search
CPC ..... B41J 2/16523; B41J 2/1721; B41J 2002/1728; B41J 2/185; B41J 2002/1856
See application file for complete search history.

(56) References Cited

U.S. PATENT DOCUMENTS 7,360,864 B2 * 4/2008 Kawai ..... B41J 2/1721 347/36
2017/0106687 A1 4/2017 Ono et al.
2017/0203572 A1 7/2017 Takekoshi et al.
2020/0086649 A1 3/2020 Tojo

FOREIGN PATENT DOCUMENTS

JP 2017074694 A 4/2017
JP 2018039144 A 3/2018
JP 2020044687 A 3/2020

* cited by examiner

*Primary Examiner* — Geoffrey S Mruk
(74) *Attorney, Agent, or Firm* — CHIP LAW GROUP

(57) ABSTRACT

A waste liquid container includes an accommodation chamber including an opening that is open upward of the waste liquid container in a mounted state where the waste liquid container is mounted in the mounting portion, the accommodation chamber being configured to accommodate the liquid, and a contact portion provided at a surface that intersect with a bottom surface and an upper surface of the waste liquid container, the contact portion being configured to contact a horizontal plane and set a posture of the accommodation chamber with respect to the horizontal plane in a placement state where the waste liquid container is placed at the horizontal plane with the surface facing downward, wherein in the placement state, an inner surface is in an inclined state where the bottom surface is lower than the upper surface, the inner surface serving as a lower surface of the accommodation chamber.

10 Claims, 19 Drawing Sheets

WASTE LIQUID CONTAINER

The present application is based on, and claims priority from JP Application Serial Number 2020-152848, filed Sep. 11, 2020, the disclosure of which is hereby incorporated by reference herein in its entirety.

BACKGROUND

1. Technical Field

The present disclosure relates to a waste liquid container that accommodates waste liquid.

2. Related Art

Recently, as illustrated in JP-A-2018-39144, there is an ink jet-type printer that is an example of a liquid jet device that performs printing by jetting ink, which is an example of liquid, onto a medium such as paper. A waste liquid container accommodating waste ink discharged from the printer as waste liquid is detachably mounted in the mounting chamber in the printer. The waste liquid container includes a waste liquid accommodation chamber accommodating the waste liquid. The waste liquid container includes an opening in a ceiling portion of the waste liquid container in a mounted state where the waste liquid container is mounted in the mounting chamber.

However, in the waste liquid container described in JP-A-2018-39144, when the waste liquid container is placed in a posture where the opening of the waste liquid accommodation chamber is in a lateral position, it is possible for the waste liquid in the waste liquid accommodation chamber to flow in a direction toward the opening, and in this case, the waste liquid may leak out of the waste liquid container.

SUMMARY

A waste liquid container is detachably mounted in a mounting portion including a discharge portion configured to discharge liquid, the waste liquid container including an accommodation chamber including an opening that is open upward of the waste liquid container in a mounted state where the waste liquid container is mounted in the mounting portion, the accommodation chamber being configured to accommodate the liquid, and a contact portion provided at a first surface of a plurality of side surfaces that intersect with a bottom surface and an upper surface of the waste liquid container in the mounted state, the contact portion being configured to contact a horizontal plane and set a posture of the accommodation chamber with respect to the horizontal plane in a placement state where the waste liquid container is placed at the horizontal plane with the first surface facing downward, wherein in the placement state, an inner surface serving as a lower surface of the accommodation chamber is in an inclined state where a side of the bottom surface is lower than a side of the upper surface.

DESCRIPTION OF EXEMPLARY EMBODIMENTS

1. First Exemplary Embodiment

Figure 1:
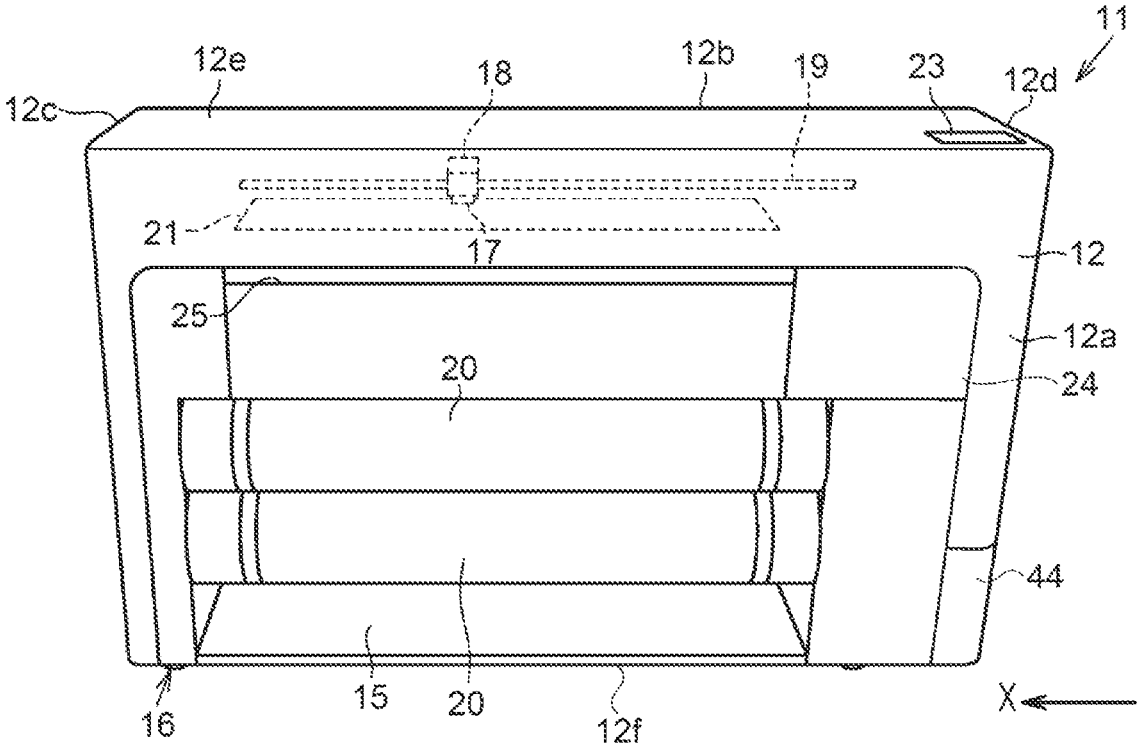
FIG. 1 is a front perspective view illustrating a schematic configuration of an exemplary embodiment of a liquid jet device.

Hereinafter, an exemplary embodiment of a waste liquid container and a liquid jet device including the waste liquid container will be described with reference to the drawings. The liquid jet device is, for example, an ink jet-type printer that performs printing by jetting ink, which is an example of liquid, onto a medium such as paper. The waste liquid container is a container accommodating waste liquid discharged from the liquid jet device.

In the drawings, a direction of gravity is indicated by the Z-axis, and a direction along a horizontal plane is indicated by the X-axis and the Y-axis, assuming that a printer 11 is placed at the horizontal plane. The X-axis, the Y-axis, and the Z-axis are mutually orthogonal. In the following description, a direction parallel with the Z-axis is also referred to as a gravitational direction Z.

Figure 2:
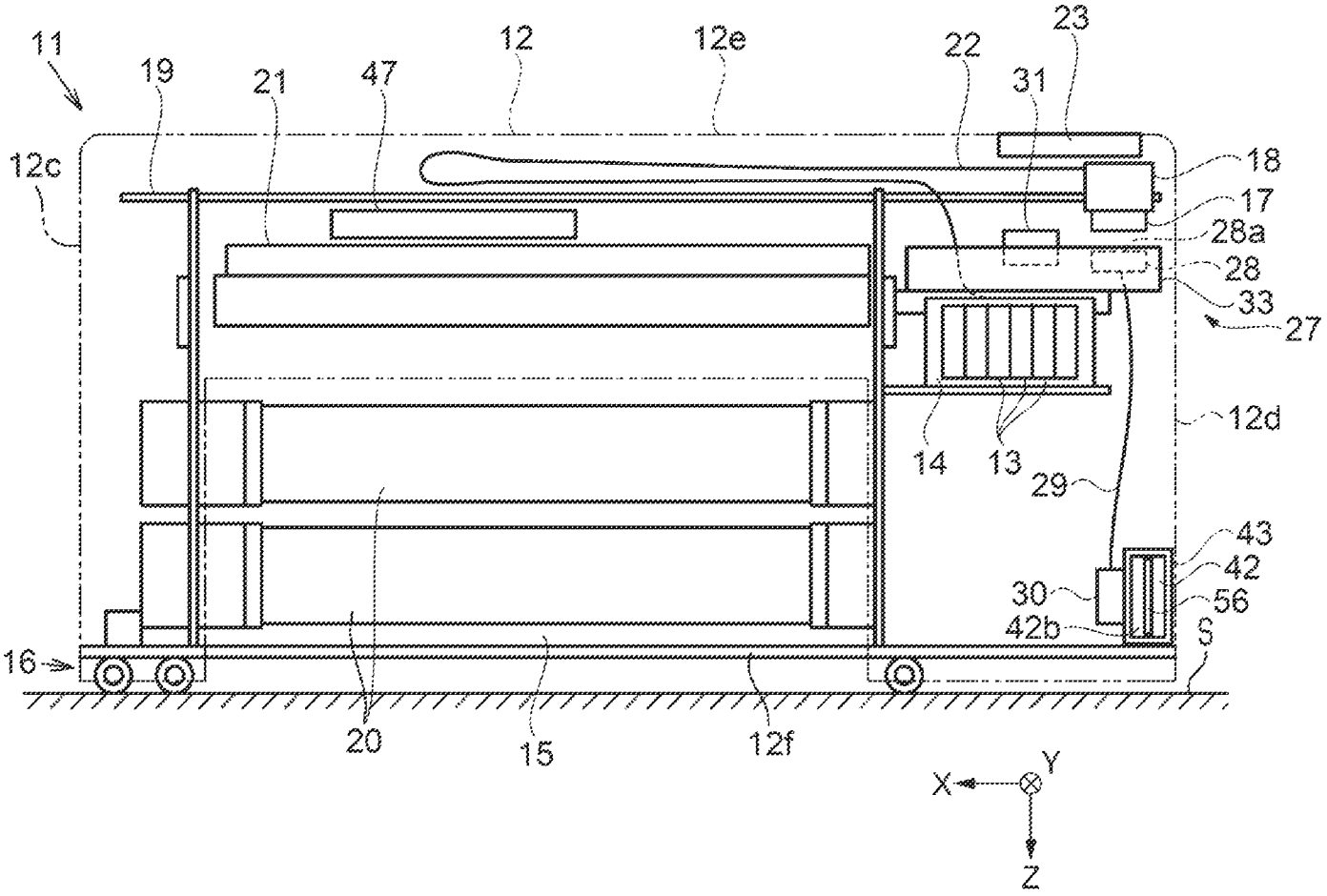
FIG. 2 is a front view schematically illustrating a portion of an internal structure within a housing.

As illustrated in FIG. 1, the printer 11 includes a housing 12, a medium accommodation portion 15, and a leg portion 16. The housing 12 has a front wall 12*a*, a rear wall 12*b*, a first wall 12*c*, a second wall 12*d*, an upper wall 12*e*, and a bottom wall 12*f*. As illustrated in FIG. 2, the leg portion 16 is provided at the bottom wall 12*f* and supports the housing 12 of the printer 11 installed at an installation surface S. Note that in FIGS. 1 to 3, a width direction of the printer 11 in which the first wall 12*c* and the second wall 12*d* face each other is indicated by the X-axis, a front-rear direction of the printer 11 in which the front wall 12*a* and the rear wall 12*b* face each other is indicated by the Y-axis, and a height direction of the printer 11 is indicated by the Z-axis.

As illustrated in FIG. 1, the printer 11 includes the medium accommodation portion 15. The medium accommodation portion 15 accommodates a medium 20 wound in a roll shape. The medium accommodation portion 15 is provided on a bottom wall 12*f* side of the front wall 12*a* of the housing 12. In the present exemplary embodiment, the medium accommodation portion 15 is configured to allow a pair of the media 20 wound in a roll shape to be accommodated in a state being aligned in the height direction of the printer 11.

As illustrated in FIGS. 1 and 2, the printer 11 includes a liquid jet portion 17 configured to jet ink. The printer 11 includes a carriage 18 that reciprocates the liquid jet portion 17 along the X-axis, a guide shaft 19 that guides movement of the carriage 18, and a support 21 that supports the medium 20.

The printer 11 includes an operation unit 23. The operation unit 23 is provided at the upper wall 12*e* of the housing 12. The operation unit 23 is located at a corner portion formed by a portion where the front wall 12*a* is coupled to the upper wall 12*e* and a portion where the second wall 12*d* is coupled to the upper wall 12*e*. The operation unit 23 is configured, for example, by a touch panel, etc., and is used by a user to input various types of information.

The liquid jet portion 17 performs printing by jetting ink on the medium 20 transported from the medium accommodation portion 15 and supported by the support 21. The printed medium 20 is discharged out of the housing 12 from an outlet 25 formed at the front wall 12*a* of the housing 12.

As illustrated in FIG. 2, the printer 11 includes an accommodation portion 14 that accommodates a liquid accommodation body 13 capable of accommodating ink. The accommodation portion 14 accommodates a plurality of liquid accommodation bodies 13 in a manner such that the liquid accommodation bodies 13 are aligned in the width direction X. The liquid accommodation portion 13 of the present exemplary embodiment is a replaceable cartridge. The liquid accommodation portion 13 may be a tank having an inlet through which liquid can be injected. As illustrated in FIG. 1, the printer 11 includes an open/close cover 24 that covers the accommodation portion 14. The open/close cover 24 constitutes a portion of the front wall 12*a* of the housing 12. The open/close cover 24 is provided at the housing 12 so that the open/close cover 24 rotates about the center of the shaft and is movable between a closed position illustrated in FIG. 1 in which a front wall 12*a* side of the accommodation portion 14 is covered and an open position in which the accommodation portion 14 is exposed.

The printer 11 includes a supply flow path 22 that supplies liquid from the liquid accommodation portion 13 to the liquid jet portion 17. A portion of the supply flow path 22 may be formed by an elastically deformable tube, for example.

The printer 11 includes a maintenance device 27 that maintains the liquid jet portion 17. The maintenance device 27 includes a cap 28 capable of collecting ink discharged from the liquid jet portion 17 as waste liquid, a discharge flow path 29 through which an upstream end thereof is coupled to the cap 28, and a suction mechanism 30 arranged midway on the discharge flow path 29. The maintenance device 27 includes a support member 33 that supports the cap 28 and a wiping member 31 capable of wiping the liquid jet portion 17.

The cap 28 contacts the liquid jet portion 17, forms a closed space between the cap and the liquid jet portion 17, and then caps the liquid jet portion 17. The maintenance device 27 performs suction cleaning by driving the suction mechanism 30 with the cap 28 capping the liquid jet portion 17, thereby performing suction in the liquid jet portion 17 through the discharge flow path 29 and the cap 28. The suction cleaning is a maintenance by which air bubbles, foreign objects, etc. in the liquid jet portion 17 are discharged from the liquid jet portion 17 together with the ink.

The printer 11 includes a mounting portion 43 at which a waste liquid container 42 accommodating the waste liquid discharged in association with the maintenance of the liquid jet portion 17 is detachably mounted. As illustrated in FIG. 1, the printer 11 includes an open/close cover 44 that covers the mounting portion 43. The open/close cover 44 constitutes a portion of the front wall 12*a* of the housing 12. The open/close cover 44 is provided at the housing 12 so that the open/close cover 44 rotates about the center of the shaft and is movable between a closed position illustrated in FIG. 1 that covers the front wall 12*a* side of the mounting portion 43 and an open position in which the mounting portion 43 is exposed.

The printer 11 includes a control unit 47 configured to control various operations executed by the printer 11. The control unit 47 is configured, for example, by a processing circuit including a computer and a memory. The control unit 47 controls the liquid jet portion 17, the maintenance device 27, etc. in accordance with a program stored in the memory.

Figure 3:
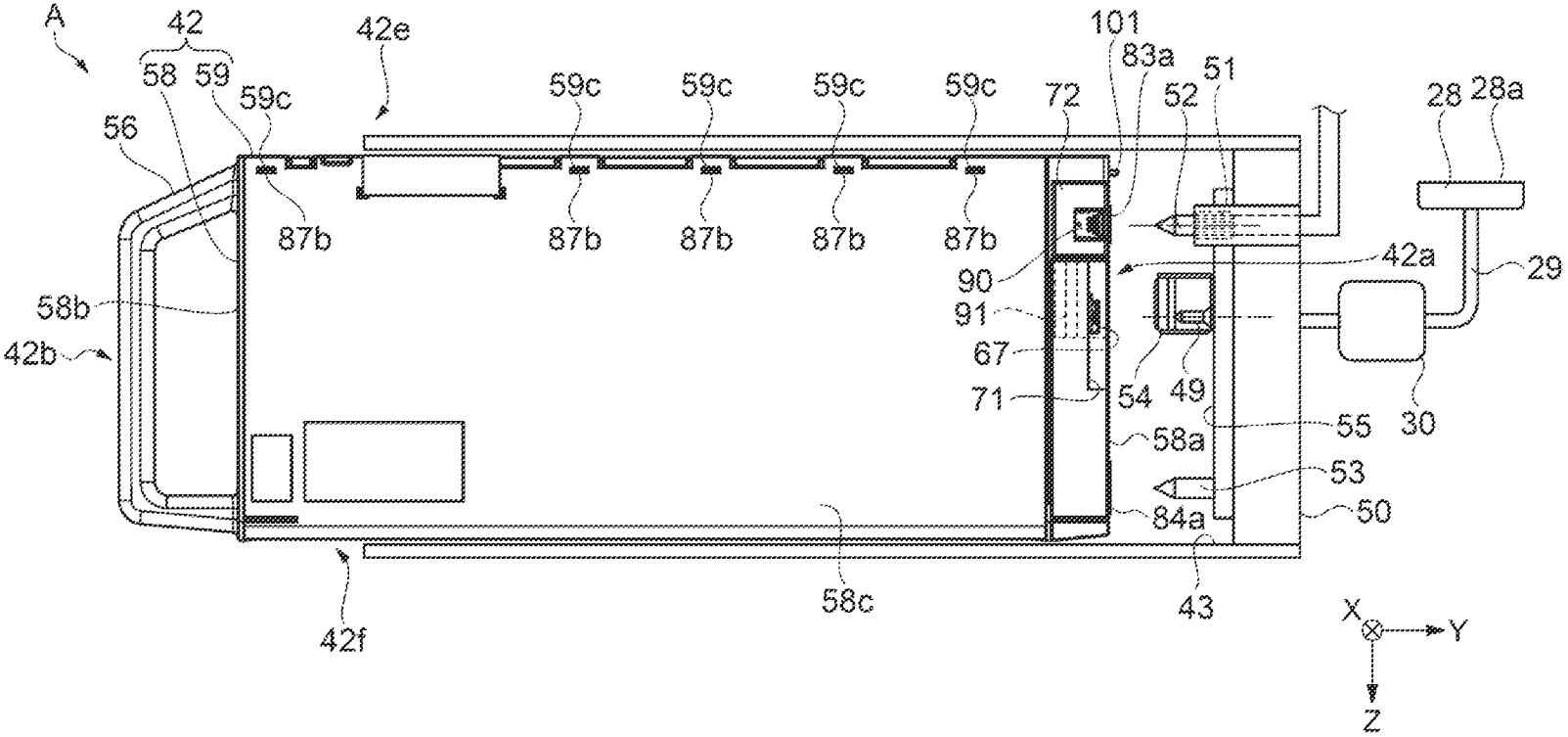
FIG. 3 is a schematic side view illustrating a mounting portion and a waste liquid container in a mounting posture.
Figure 4A:
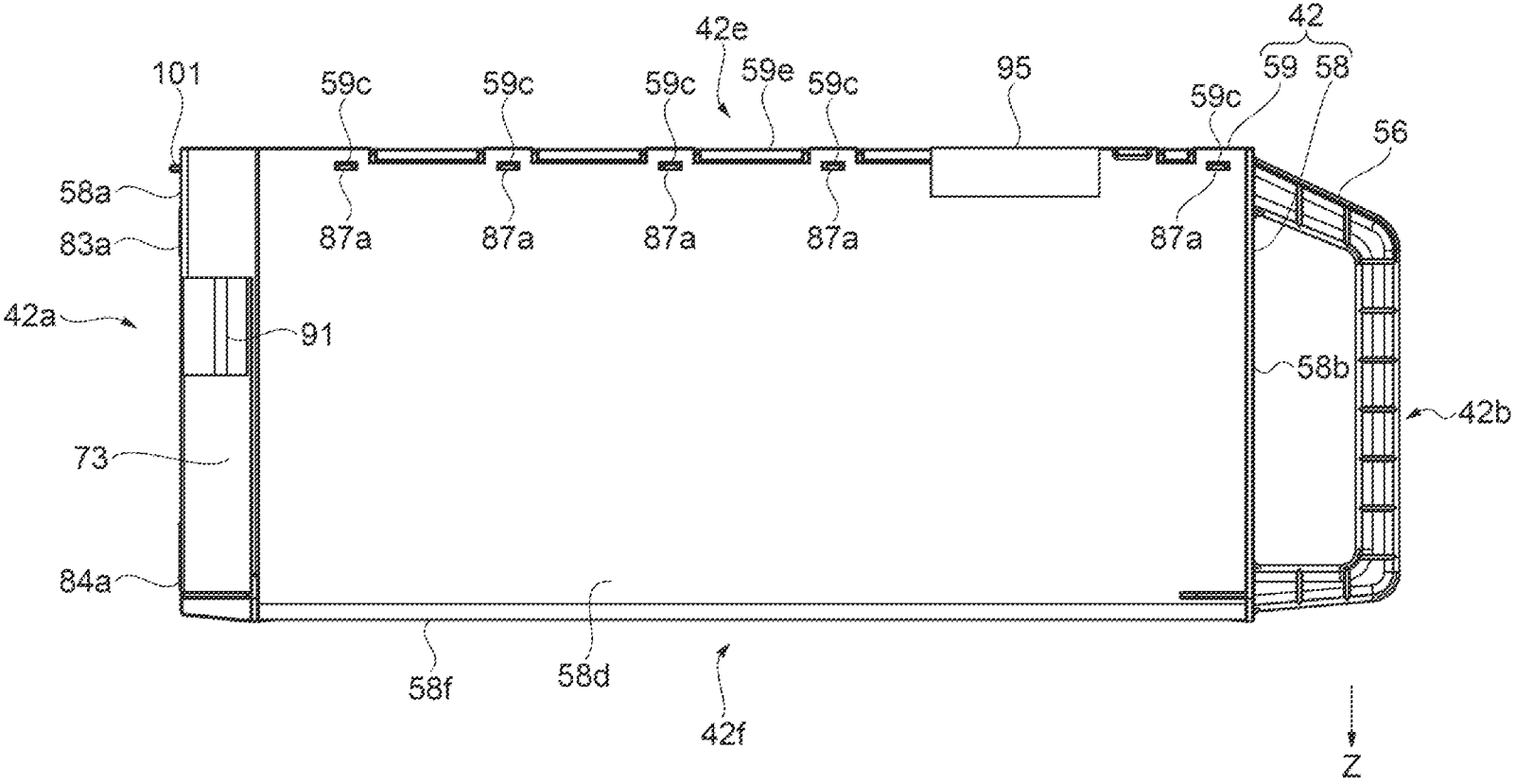
FIG. 4A is a side view of the waste liquid container in the mounting posture as viewed from a fourth surface side.
Figure 4B:
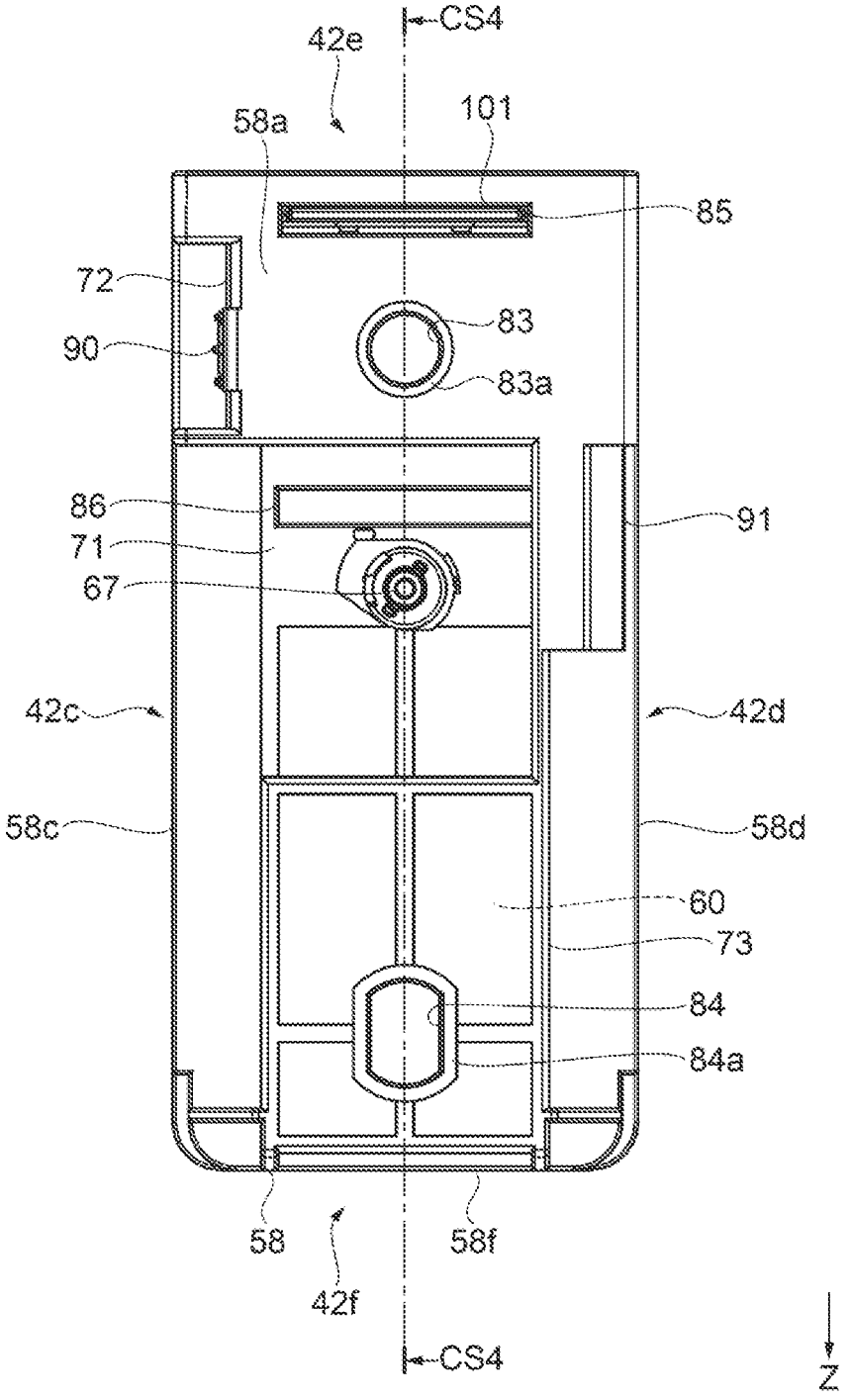
FIG. 4B is a side view of the waste liquid container in the mounting posture as viewed from a first surface side.
Figure 4C:
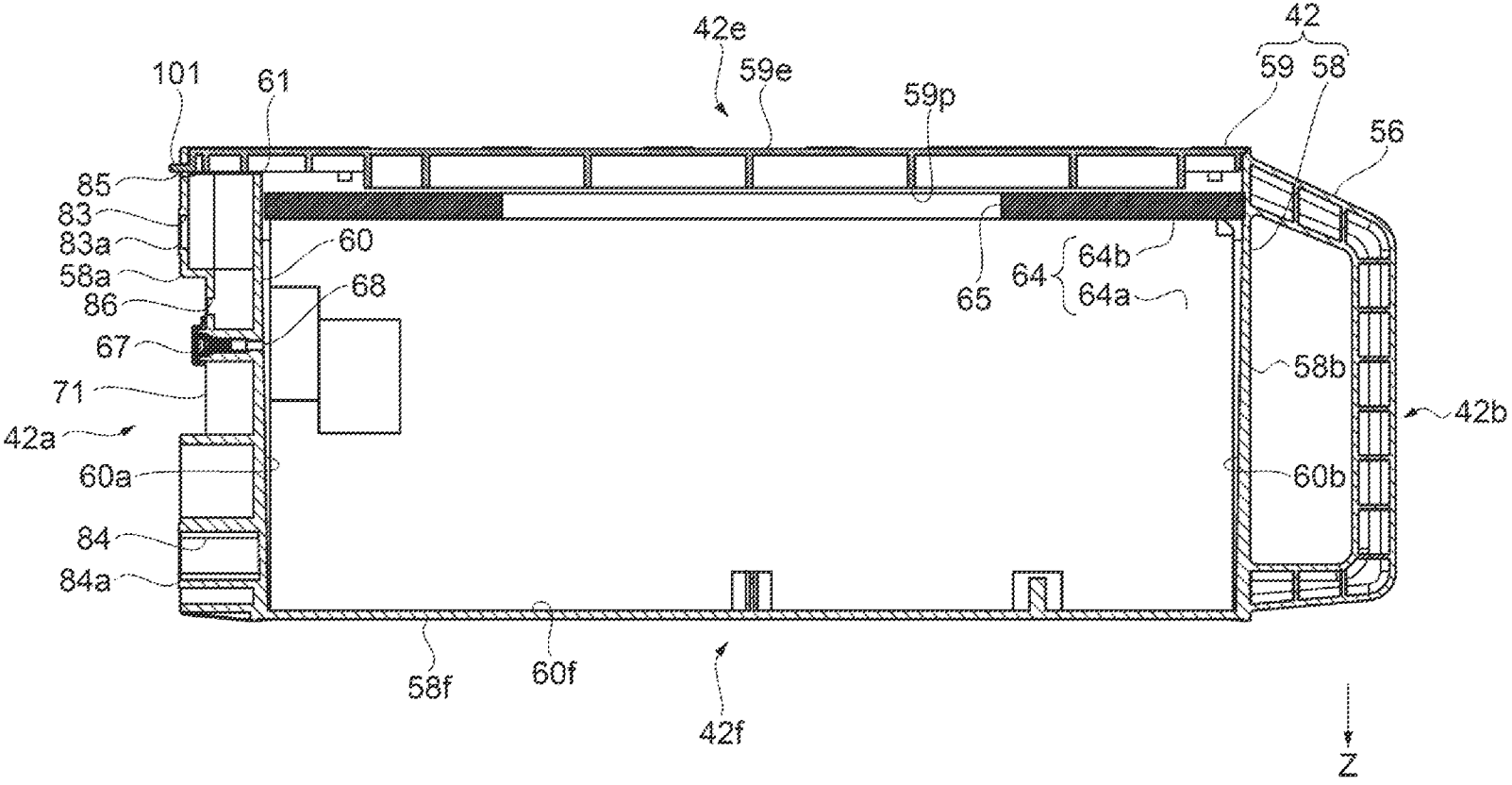
FIG. 4C is a cross-sectional view of the waste liquid container.
Figure 5:
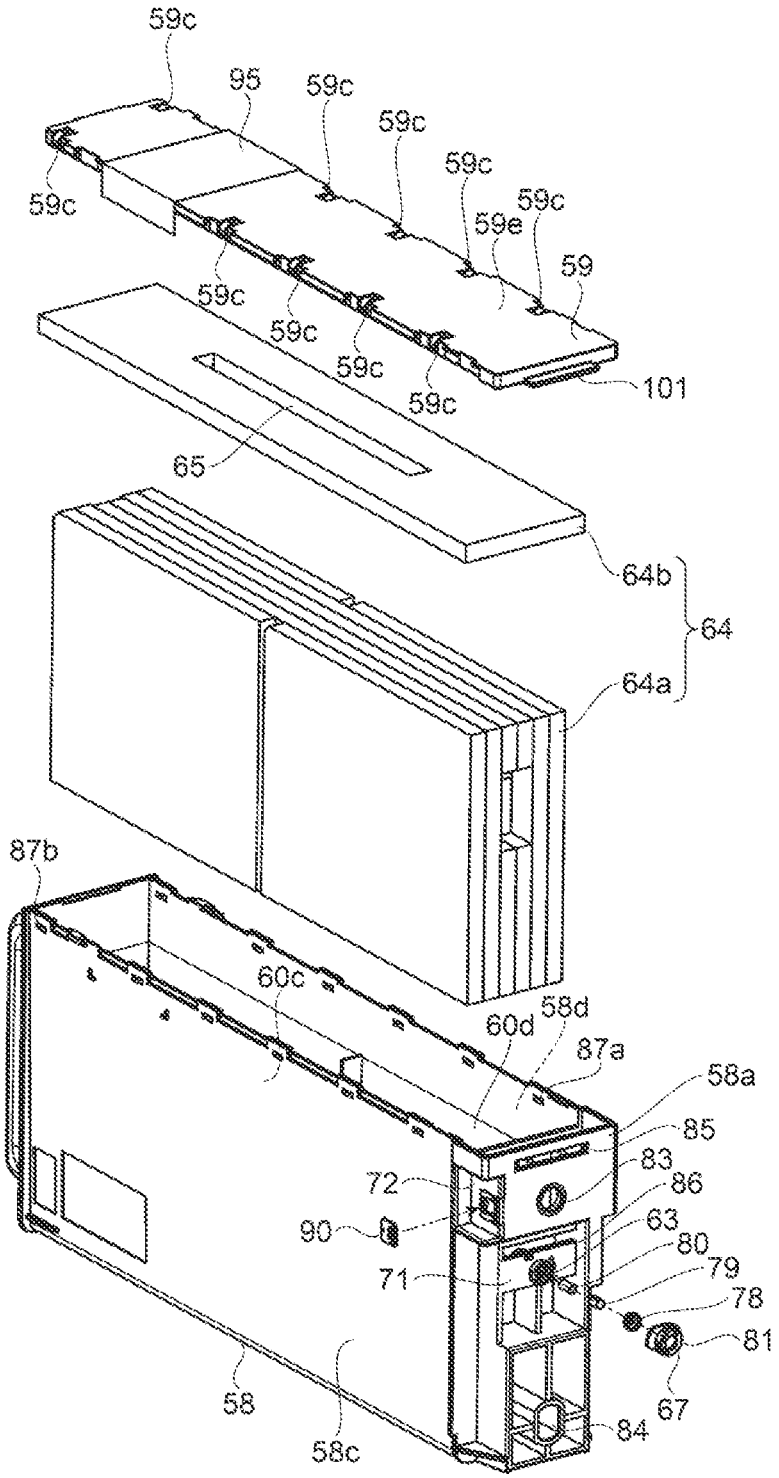
FIG. 5 is an exploded perspective view of the waste liquid container.
Figure 6:
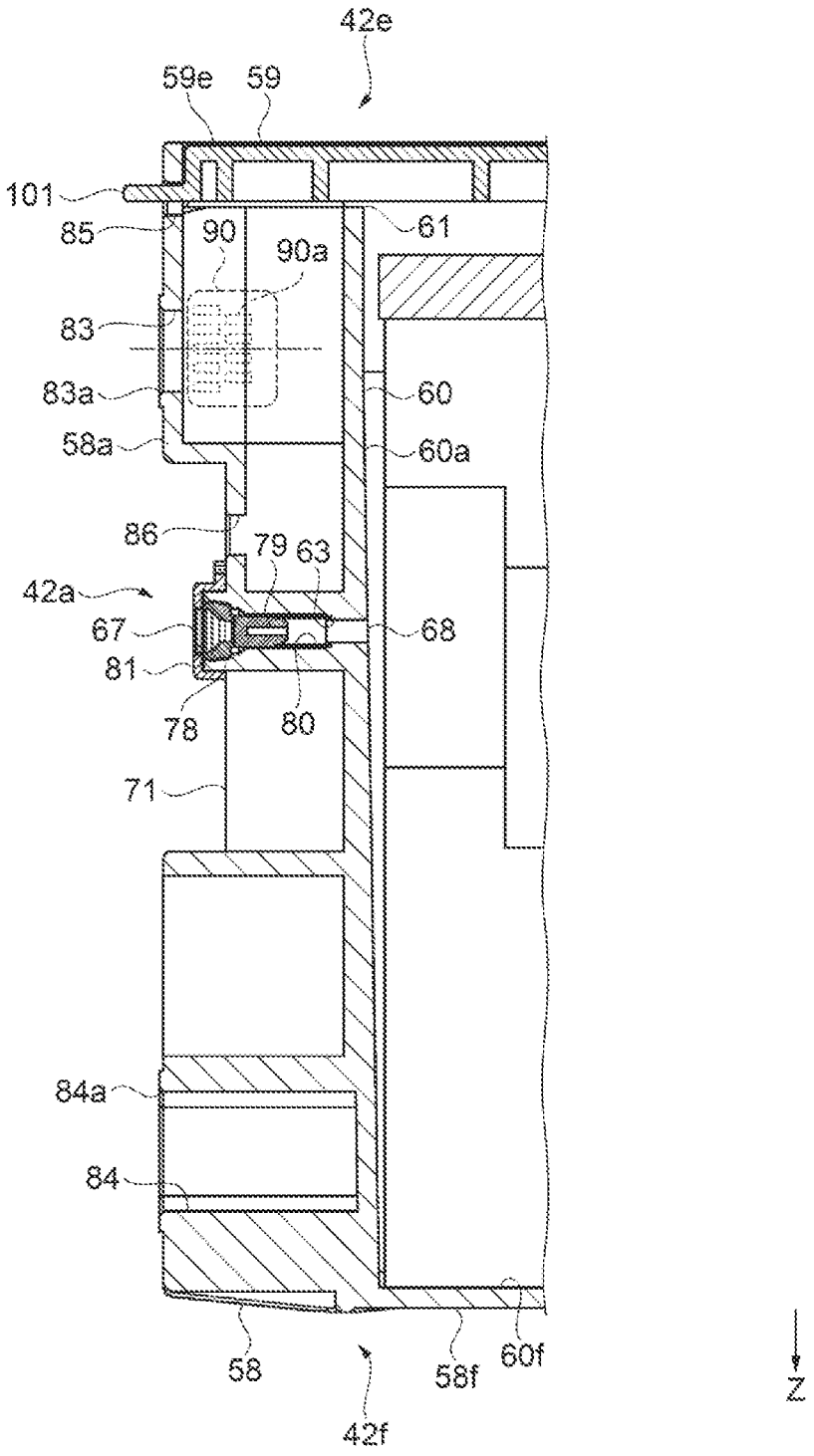
FIG. 6 is a partial cross-sectional view illustrating the internal structure of the waste liquid container in the mounting posture.

FIG. 3 is a schematic side view illustrating the mounting portion 43 and the waste liquid container 42 in a mounting posture. FIG. 4A is a side view of the waste liquid container 42 in the mounting posture A as viewed from a fourth surface 42*d* side. FIG. 4B is a side view of the waste liquid container 42 in the mounting posture A as viewed from a first surface 42*a* side. FIG. 4C is a cross-sectional view taken along a line CS4-CS4 of FIG. 4B. FIG. 5 is an exploded perspective view of the waste liquid container 42. FIG. 6 is an enlarged partial cross-sectional view of the first surface 42*a* side of the waste liquid container 42 in the cross section taken along the line CS4-CS4 of FIG. 4B. As illustrated in FIG. 3, the mounting portion 43 includes a discharge tube 49 as a discharge portion provided at a rear wall 12*b* side of the housing 12, which is the back of the mounting portion 43, a holder 50 that holds the discharge tube 49, and a mounting portion side coupling terminal 51 electrically coupled to the control unit 47. The mounting portion 43 includes a positioning pin 52 and a regulating pin 53 that protrude from the holder 50 toward the front in which an opening of the mounting portion 43 is located. The mounting portion 43 also includes a lock portion 54 that engages with the waste liquid container 42 mounted in the mounting portion 43, and a regulating portion 55.

The mounting portion side coupling terminal 51 is provided so that, in the gravitational direction Z, the central axis of the positioning pin 52 is located between terminals at both ends of a plurality of terminals included in the mounting portion side coupling terminal 51. In the gravitational direction Z, the locking portion 54 is provided such that the central axis of the discharge tube 49 is located within the longitudinal width of the locking portion 54 in the mounting posture A. The discharge tube 49 is located between the positioning pin 52 and the regulating pin 53 in the gravitational direction Z. In the gravitational direction Z, the distance between the mounting portion side coupling terminal 51 and the positioning pin 52 is shorter than the distance between the positioning pin 52 and the discharge tube 49. A downstream end of the discharge flow path 29 is coupled to the discharge tube 49. In other words, the discharge tube 49 is coupled to the cap 28 via the discharge flow path 29.

When surfaces defining an outer contour of the waste liquid container 42 are referred to as a first surface 42*a*, a second surface 42*b*, a third surface 42*c*, a fourth surface 42*d*, a fifth surface 42*e*, and a sixth surface 42*f*, as illustrated in FIGS. 3 to 4B, the waste liquid container 42 includes a gripping portion 56 at the second surface 42*b*, as illustrated in FIG. 3. With the open/close cover 44 in the open position, the waste liquid container 42 is inserted into the mounting portion 43 from the front in the mounting posture A in which the gripping portion 56 is in the front. Then the waste liquid container 42 is moved in the mounting direction Y from the front wall 12*a* side of the housing 12 toward the rear wall 12*b* side to be mounted in the mounting portion 43, as illustrated in FIG. 3. The mounting direction Y in the present exemplary embodiment is a direction along the front-back direction of the printer 11.

The waste liquid container 42 is moved further in the mounting direction Y from the position illustrated in FIG. 3. The waste liquid container 42 is maintained in the mounting posture A even in a mounted state of being mounted in the mounting portion 43. In the mounting posture A, the sixth surface 42*f* of the waste liquid container 42 is a bottom surface, and the fifth surface 42*e* is an upper surface, and the first surface 42*a*, the second surface 42*b*, the third surface 42*c*, and the fourth surface 42*d* are surfaces that intersect with the bottom surface and the upper surface. In addition, in the mounting direction Y, the first surface 42*a* of the waste liquid container 42 is the front surface.

In the mounted state in which the waste liquid container 42 is mounted in the mounting portion 43 of the printer 11, the lock portion 54 engages a locked portion 91, and restricts movement of the waste liquid container 42 in an extraction direction in which it is removed from the mounting portion 43. The locking section 54 is constituted by, for example, a leaf spring.

As illustrated in FIG. 4A, the waste liquid container 42 includes an accommodation container 58. As illustrated in FIGS. 4C to 6, the accommodation container 58 includes the accommodation chamber 60 capable of accommodating waste liquid as a liquid. The accommodation chamber 60 includes an inner surface 60*f* serving as an inner bottom surface in the mounting posture A, and inner surfaces 60*a* to 60*d* serving as inner surfaces that intersect with the inner surface 60*f*. Furthermore, the accommodation chamber 60 has an opening 61 that opens upward of the waste liquid container 42 in the mounting posture A.

As illustrated in FIG. 4C and FIG. 5, the waste liquid container 42 includes an absorbent body 64 capable of absorbing the waste liquid accommodated in the accommodation chamber 60. The accommodation chamber 60 may accommodate a plurality of absorbent bodies 64*a* aligned in the X direction and an absorbent body 64*b* arranged to cover an opening 61 side of the absorbent bodies 64*a*. A through hole 65 is provided at the absorbent body 64*b*.

As illustrated in FIG. 4A, the waste liquid container 42 includes a cover 59 that covers the opening 61 of the accommodation chamber 60. The cover 59 includes a lid portion 59*e* that constitutes the fifth surface 42*e* of the waste liquid container 42. As illustrated in FIG. 4C and FIG. 5, a clamping portion 59*p* protruding toward an opening 61 side of the accommodation chamber 60, a plurality of attachment fingers 59*c*, and a protrusion 101 are integrally provided at the lid portion 59*e*. As illustrated in FIG. 4C, the clamping portion 59*p* regulates the movement of the absorbent body 64 from the inner surface 60*f* of the accommodation chamber 60 toward the opening 61. An internal space of the waste liquid container 42, which is formed by the cover 59 being attached to the accommodation container 58, communicates with the outside by a gap formed between the accommodation container 58 and the cover 59.

As illustrated in FIGS. 4A and 5, the waste liquid container 42 includes a label 95. The label 95 is attached from the fifth surface 42*e* across the third surface 42*c* and the fourth surface 42*d* of the waste liquid container 42. Information regarding the waste liquid container 42 is described in the label 95.

As illustrated in FIG. 6, the accommodation container 58, which is included in the waste liquid container 42, includes a waste liquid flow path 63. The waste fluid flow path 63 is a flow path that guides the waste liquid introduced from the discharge tube 49 into the accommodation chamber 60. The discharge tube 49 discharges the waste liquid fed via the discharge flow path 29 into the waste liquid container 42 in the mounted state. In the mounted state, the accommodation chamber 60 accommodates the waste liquid discharged from the printer 11 via the waste fluid flow path 63.

The accommodation container 58, which is included in the waste liquid container 42, includes an inlet 67 as a waste liquid inlet through which the discharge tube 49 is inserted and into which the waste liquid is introduced, and a discharge port 68 that opens to the inner surface 60*a* forming the accommodation chamber 60. The waste liquid flow path 63 is a flow path coupling the discharge port 68 with the inlet 67. The discharge port 68 serving as a downstream end of the waste liquid flow path 63, discharges the waste liquid introduced from the inlet 67 serving as an upstream end of the waste liquid flow path 63, into the accommodation chamber 60. The discharge port 68 may be located below an upper end 28*a* of the cap 28 illustrated in FIGS. 2 and 3 in the mounted state. The discharge port 68 may be located below an upstream end of the discharge flow path 29 coupled to the cap 28.

As illustrated in FIGS. 4A to 4C, the accommodation container 58 includes a first side wall 58*a* constituting the first surface 42*a* a second side wall 58*b* constituting the second surface 42*b*, a third side wall 58*c* constituting the third surface 42*c*, a fourth side wall 58*d* constituting the fourth surface 42*d*, and a sixth side wall 58*f* constituting the sixth surface 42*f* of the waste liquid container 42. As illustrated in FIG. 4A, in the present exemplary embodiment, the lid portion 59*e* of the cover 59 constitutes the fifth surface 42*e* of the waste liquid container 42. In the mounting posture A, the first side wall 58*a* to the fourth side wall 58*d* serve as side walls constituting a plurality of side surfaces of the waste liquid container 42, and the sixth side wall 58*f* serves as a bottom wall constituting a bottom surface of the waste liquid container 42. Furthermore, in the mounting posture A, the cover 59 constitutes the upper surface of the waste liquid container 42.

As illustrated in FIG. 5 and FIG. 6, the accommodation container 58 provided at the waste liquid container 42 includes a cylindrical sealing member 78 constituting a portion of the waste fluid flow path 63, a valve body 79 provided in a movable manner, a pressing member 80 that presses the valve body 79 against the sealing member 78, and a cap 81 covering the seal member 78. The sealing member 78, the valve body 79, and the pressing member 80 are provided in the waste fluid flow path 63 formed at the accommodation container 58. In the present exemplary embodiment, a through hole constituting the inlet 67 of the waste fluid flow path 63 is provided at the cap 81. When the waste liquid container 42 is mounted in the mounting portion 43, the discharge tube 49 enters the inlet 67 constituted by the cap 81, and is in communication with the waste liquid flow path 63 by pressing the valve body 79.

As illustrated in FIG. 4B, the inlet 67, a positioning hole 83, a regulating hole 84, an insertion hole 85, and a communication hole 86 are provided at the first side wall 58*a* constituting the first surface 42*a* of the waste liquid container 42. The positioning hole 83 of the present exemplary embodiment is a round hole, and the regulating hole 84 is a long hole. Further, a regulated portion 83*a* is provided on an opening side of the positioning hole 83 in the first sidewall 58*a*, and a regulated portion 84*a* is provided on an opening side of the regulating hole 84 in the first sidewall 58*a*. The inlet 67 is provided at a recessed portion 71 formed at the first side wall 58*a*. In the mounting posture A, the inlet 67 is located at the center of the first side wall 58*a* in the lateral direction of the first side wall 58*a*. In other words, in the mounting posture A, the inlet 67 is located in the center of the first surface 42*a* in the lateral direction of the first surface 42*a* of the waste liquid container 42. In the mounting posture A, the inlet 67 is located between the positioning hole 83 and the regulating hole 84 in the gravitational direction Z. In addition, as illustrated in FIG. 4C, the inlet 67 is located between the regulated portion 83*a* and the regulated portion 84*a*, and the second side wall 58*b*, in the lateral width direction of the fourth side wall 58*d* in the mounting posture A illustrated in FIG. 4A.

As illustrated in FIG. 4C, in the mounting posture A, the positioning hole 83 is located closer to the opening 61 than the sixth sidewall 58*f* in the gravitational direction Z. Additionally, as illustrated in FIG. 4B, in the mounting posture A, the positioning hole 83 is located closer to the fifth surface 42*e* than the sixth surface 42*f* in the gravitational direction Z. As illustrated in FIG. 4C, in the mounting posture A, the regulating hole 84 is located closer to the sixth sidewall 58*f* than the opening 61 in the gravitational direction Z. Additionally, as illustrated in FIG. 4B, in the mounting posture A, the regulating hole 84 is located closer to the sixth surface 42*f* than the fifth surface 42*e* in the gravitational direction Z.

The positioning pin 52 is inserted into the positioning hole 83 in the mounted state. The regulating pin 53, which regulates rotation of the waste liquid container 42 around the positioning pin 52 in the mounted state, is inserted into the regulating hole 84. In other words, the waste liquid container 42 in the mounted state is positioned by the positioning pin 52, as well as the inclination about the positioning pin 52 is limited by the regulating pin 53. Furthermore, movement of the waste liquid container 42 in the mounted state in the mounting direction Y is regulated by contacting the regulated portion 83*a* and the regulated portion 84*a* with the regulating portion 55 of the mounting portion 43.

As illustrated in FIG. 4B, in the mounting posture A, the insertion hole 85 is located above the positioning hole 83 in the gravitational direction Z. In addition, as illustrated in FIG. 4C, the insertion hole 85 is located between the regulated portion 83*a* and the regulated portion 84*a*, and the second side wall 58*b*, in the lateral width direction of the fourth side wall 58*d* in the mounting posture A illustrated in FIG. 4A. The protrusion 101 of the cover 59 is inserted into the insertion hole 85 when the cover 59 is attached to the accommodation container 58. As illustrated in FIG. 4C, the protrusion 101 inserted into the insertion hole 85 protrudes from the first side wall 58*a* that constitutes the first surface 42*a* of the waste liquid container 42. In other words, a protrusion 101, which is a portion of the cover 59, passes through the first side wall 58*a* constituting the first surface 42*a* to form the protrusion on the waste liquid container 42. Additionally, as illustrated in FIG. 4B, in the mounting posture A, the protrusion 101 protruding from the first sidewall 58*a* extends across the center of the first sidewall 58*a* in the lateral direction of the first sidewall 58*a*. In other words, in the mounting posture A, the protrusion 101 protruding from the first side wall 58*a* extends across the center of the first surface 42*a* in the lateral direction of the first surface 42*a* of the waste liquid container 42. Further, the protrusion 101 is located closer to the fifth surface 42*e* serving as upper surface in the mounting posture A than the sixth surface 42*f* serving as the bottom surface in the mounting posture A.

As illustrated in FIG. 4B, in the mounting posture A, the communication hole 86 is located between the inlet 67 and the positioning hole 83 in the gravitational direction Z. Additionally, as illustrated in FIG. 4C, the communication hole 86 is located between the inlet 67 and the second side wall 58*b* in the lateral direction of the fourth side wall 58*d* in the mounting posture A illustrated in FIG. 4A. In addition to the gap between the accommodation container 58 and the cover 59, the internal space of the waste liquid container 42 may also be in communication with the outside by the communication hole 86.

As illustrated in FIG. 4C, the second side wall 58*b* constituting the second surface 42*b* of the waste liquid container 42 is located opposite to the first side wall 58*a* with the accommodation chamber 60 interposed therebetween. The gripping portion 56 is provided at the second side wall 58*b*. As illustrated in FIG. 2, the gripping portion 56 is located in the center of the second side wall 58*b* in the lateral direction of the second side wall 58*b* in the mounting posture A. In other words, the gripping portion 56 is located in the center of the second surface 42*b* in the lateral direction of the second surface 42*b* of the waste liquid container 42 in the mounting posture A.

As illustrated in FIG. 3, FIG. 4B, and FIG. 6, a circuit board 90 having a plurality of coupling terminals 90*a* that can be electrically coupled to the mounting portion coupling terminal 51 in the mounted state, and a plurality of attachment holes 87*b* are provided at the third side wall 58*c* constituting the third surface 42*c* of the waste liquid container 42. The circuit board 90 is provided at a recessed portion 72 formed at the third side wall 58*c*. As illustrated in FIG. 3, in the mounting posture A, the circuit board 90 is located closer to the first side wall 58*a* than the second side wall 58*b* in the lateral direction of the third side wall 58*c*. Further, in the mounting posture A, the circuit board 90 is located between the regulated portion 83*a* and the regulated portion 84*a*, and the second side wall 58*b* in the lateral width direction of the third side wall 58*c*.

As illustrated in FIG. 6, in the mounting posture A, the circuit board 90 is located closer to the opening 61 than the sixth sidewall 58*f* in the gravitational direction Z. In the mounting posture A, the circuit board 90 is arranged such that a central axis of the positioning hole 83 is located between coupling terminals 90*a* at both ends in the gravitational direction Z of the plurality of coupling terminals 90*a* included in the circuit board 90. Further, the circuit board 90 is located closer to a fifth surface 42*e* side serving as the upper surface than the inlet 67 in the mounting posture A. In the mounting posture A, the circuit board 90 is located above the inlet 67 in the gravitational direction Z. As illustrated in FIG. 5, the circuit board 90 is, for example, a thin plate IC chip. The circuit board 90 may include a storage unit that stores information related to the waste liquid container 42.

In the mounting posture A, the plurality of attachment holes 87*b* may be located above the opening 61 in the gravitational direction Z. As illustrated in FIG. 3, in the mounting posture A, the plurality of attachment holes 87*b* are arranged at intervals in the lateral width direction of the third side wall 58*c*.

As illustrated in FIG. 4B, the fourth side wall 58*d* constituting the fourth surface 42*d* of the waste liquid container 42 is located opposite to the third side wall 58*c* with the accommodation chamber 60 interposed therebetween. As illustrated in FIG. 4A, the locked portion 91 that is locked to the locking portion 54 of the printer 11 in the mounted state, and the plurality of attachment holes 87*a*, are provided at the fourth side wall 58*d*. The locked portion 91 is provided at a recessed portion 73 formed at the fourth side wall 58*d*. In the mounting posture A, the locked portion 91 is located closer to the first side wall 58*a* than the second side wall 58*b* in the lateral width direction of the fourth side wall 58*d*. Further, in the mounting posture A, the locked portion 91 is located between the regulated portion 83*a* and the regulated portion 84*a*, and the second side wall 58*b*, in the lateral width direction of the third side wall 58*c*. Additionally, as illustrated in FIG. 3, in the mounting posture A, the locked portion 91 is located between the inlet 67 and the second side wall 58*b* in the lateral width direction of the third side wall 58*c*.

As illustrated in FIG. 4B, in the mounting posture A, the locked portion 91 is located between the positioning hole 83 and the regulating hole 84 in the gravitational direction Z. In the mounting posture A, the locked portion 91 is located between the regulated portion 83*a* and the regulated portion 84*a* in the gravitational direction Z. In the mounting posture A, the locking section 91 is located below the circuit board 90 in the gravitational direction Z. In the mounting posture A, the locking section 91 is provided such that the inlet 67 is located in the longitudinal width of the locked portion 91 in the gravitational direction Z.

In the mounting posture A, the plurality of attachment holes 87*a* may be located above the opening 61 in the gravitational direction Z. As illustrated in FIG. 4A, in the mounting posture A, the plurality of attachment holes 87*a* are arranged at intervals in the lateral width direction of the fourth side wall 58*d*. The cover 59 is attached to the accommodation container 58 by the plurality of attachment fingers 59*c* of the cover 59 entering the plurality of attachment holes 87*a* and the attachment holes 87*b*.

A footprint in the case where the waste liquid container 42 of the present exemplary embodiment is stored, is the smallest when the first surface 42*a* or the second surface 42*b* is stored facing downward. The footprint is the second smallest when the fifth surface 42*e* or the sixth surface 42*f* is stored facing downward, and is the greatest when the third surface 42*c* or the fourth surface 42*d* is stored facing downward. In addition, since the gripping portion 56 is provided at the second surface 42*b*, the waste liquid container 42 removed from the mounting portion 43 has a high probability of storing the first surface 42*a* facing downward.

Figure 7A:
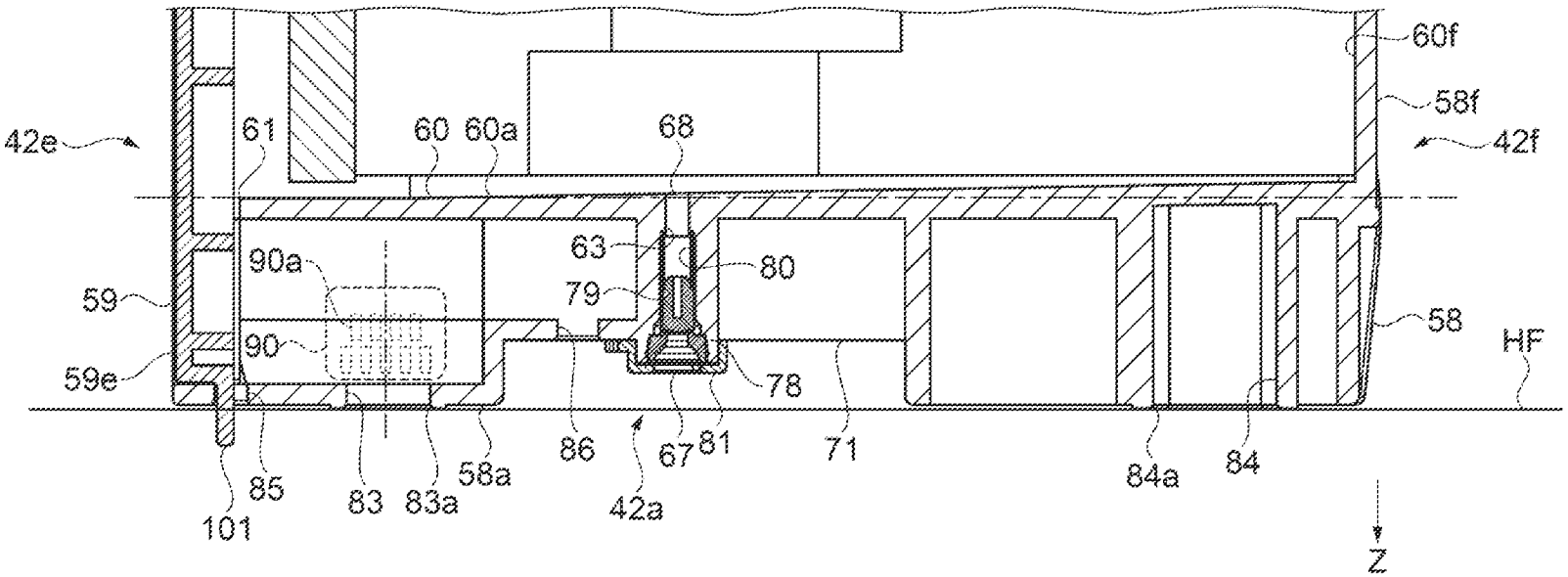
FIG. 7A is a partial cross-sectional view illustrating the waste liquid container in a placement state in the absence of a protrusion.

FIG. 7A illustrates a placement state in which the waste liquid container 42 is placed at a horizontal plane HF with the first surface 42*a* facing downward, assuming that there is no protrusion 101 in the present exemplary embodiment. In this case, the posture of the waste liquid container 42 is defined by contacting the regulated portion 83*a* and the regulated portion 84*a* of the waste liquid container 42 with the horizontal plane HF.

At this time, as can be seen from a comparison between the inner surface 60*a* and a two-dot chain line parallel to the horizontal plane HF illustrated in FIG. 7A, the inner surface 60*a* serving as a lower surface of the accommodation chamber 60 is in an inclined state where the fifth surface 42*e* side serving as the upper surface in the mounting posture A is lower than the sixth surface 42*f* side serving as the bottom surface in the mounting posture A. In this manner, when the waste liquid container 42 is placed in the inclined state where the opening 61 side of the inner surface 60*a* serving as the lower surface of the accommodation chamber 60 is lower than the inner surface 60*f* side of the inner surface 60*a*, the waste liquid in the accommodation chamber 60 may flow toward the opening 61, and there is a risk that the waste liquid may leak out of the waste liquid container 42.

Figure 7B:
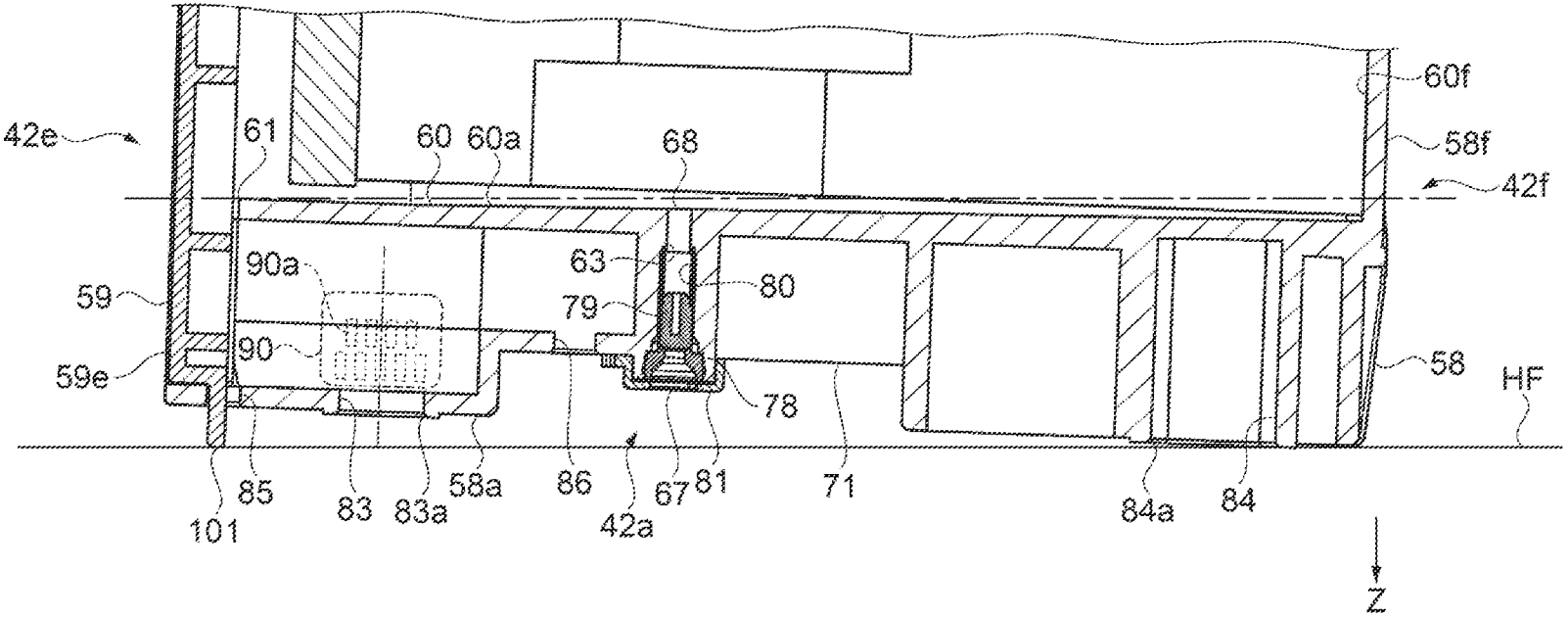
FIG. 7B is a partial cross-sectional view illustrating the waste liquid container according to a first exemplary embodiment in the placement state.

FIG. 7B illustrates the placement state in which the waste liquid container 42 is placed at the horizontal plane HF with the first surface 42*a* facing downward when the protrusion 101 in the present exemplary embodiment protrudes from the first side wall 58*a* constituting the first surface 42*a* of the waste liquid container 42. In this case, the protrusion 101 and the regulated portion 84*a* as contact portions come into contact with the horizontal plane HF, thereby setting the postures of the waste liquid container 42 and the accommodation chamber 60 included in the waste liquid container 42.

In the placement state, as can be seen from a comparison between the inner surface 60*a* and a two-dot chain line parallel to the horizontal plane HF illustrated in FIG. 7B, the inner surface 60*a* serving as the lower surface of the accommodation chamber 60 is in the inclined state where the sixth surface 42*f* side serving as the bottom surface in the mounting posture A is lower than the fifth surface 42*e* side serving as the upper surface in the mounting posture A. As described above, according to the present exemplary embodiment, in the placement state of being placed at the horizontal plane HF with the first surface 42*a* facing downward, the waste liquid container 42 is in the inclined state where the inner surface 60*f* side of the inner surface 60*a* serving as the lower surface of the accommodation chamber 60 is lower than the opening 61 side of the inner surface 60, thereby it is possible to prevent the waste liquid in the accommodation chamber 60 from flowing toward the opening 61 and leaking out of the waste liquid container 42.

As illustrated in FIG. 7B, the inlet 67 is separated from the horizontal plane HF in the placement state. Furthermore, in the placement state, the first surface 42*a* of the waste liquid container 42 is in the inclined state where the sixth surface 42*f* side serving as the bottom surface in the mounting posture A is lower than the fifth surface 42*e* side serving as the upper surface in the mounting posture A.

As described above, according to the first exemplary embodiment, the following effects can be obtained.

The waste liquid container 42 is a waste liquid container detachably mounted in the mounting portion 43 including the discharge tube 49 configured to discharge liquid, the waste liquid container 42 including the accommodation chamber 60 including the opening 61 that opens upward of the waste liquid container 42, the accommodation chamber being configured to accommodate the liquid, in the mounted state where the waste liquid container 42 is mounted in the mounting portion 43, and the contact portion provided at the first surface 42*a* of the first surface 42*a* to the fourth surface 42*d* that intersect with the sixth surface 42*f* serving as the bottom surface and the fifth surface serving 42*e* as the upper surface of the waste liquid container 42 in the mounted state, the contact portion being configured to contact the horizontal plane HF and set the posture of the accommodation chamber 60 with respect to the horizontal plane HF, in the placement state where the waste liquid container 42 is placed at the horizontal plane HF with the first surface 42*a* facing downward, wherein in the placement state, the inner surface 60*a* is in the inclined state where a side of the sixth surface 42*f* is lower than a side of the fifth surface 42*e*, the inner surface serving as the lower surface of the accommodation chamber 60. According to this configuration, when the first surface 42*a* of the waste liquid container 42 is placed facing downward, the waste liquid as liquid in the waste liquid container 42 flows toward the opening 61 side of the accommodation chamber 60, whereby it is possible to suppress leakage out of the accommodation chamber 60.

The contact portion included in the waste liquid container 42 includes the protrusion 101 provided at the first surface 42*a*. According to this configuration, the contact portion can be easily provided.

The protrusion 101 included in the waste liquid container 42 extends across the center in the lateral direction of the first surface 42*a* in the mounted state. According to this configuration, when the first surface 42*a* of the waste liquid container 42 is placed facing downward, the posture of the waste liquid container 42 can be stabilized.

The protrusion 101 included in the waste liquid container 42 is located closer to the fifth surface 42*e* than the sixth surface 42*f*. According to this configuration, when the first surface 42*a* of the waste liquid container 42 is placed facing downward, the inclined state where the inner surface 60*a* serves as the lower surface of the accommodation chamber 60 is easily stabilized.

The waste liquid container 42 includes the cover 59 that constitutes the fifth surface 42*e* of the waste liquid container 42 and covers the opening 61 of the accommodation chamber 60. The protrusion 101 is integrally formed with the cover 59. According to this configuration, by covering the opening 61 of the accommodation chamber 60 with the cover 59, it is possible to suppress the leak of waste liquid in the waste liquid container 42 out of the accommodation chamber 60. Further, the protrusion 101 may be easily provided by the cover 59.

The protrusion included in the waste liquid container 42 is provided at the first surface 42*a* by the protrusion 101 of the cover 59 extending through the first surface 42*a*. According to this configuration, the cover 59 can easily provide protrusions.

The waste liquid container 42 is provided with the inlet 67 into which the liquid discharged from the discharge tube 49 is introduced to the first surface 42*a*, which is the front surface in the mounting direction when the waste liquid container 42 is mounted in the mounting portion 43. According to this configuration, the waste liquid container 42 can be easily coupled to the discharge tube 49.

The inlet 67 of the waste liquid container 42 is separated from the horizontal plane HF in the placement state. According to this configuration, when the first surface 42*a* of the waste liquid container 42 is placed facing downward, it is possible to suppress the attachment of the waste liquid adhered to the inlet 67 to the placement surface.

The waste liquid container 42 further includes the circuit board 90 having the coupling terminal 90*a* electrically coupled to the mounting portion side coupling terminal 51 provided at the mounting portion 43. In the placement state, the first surface 42*a* is in the inclined state where the sixth surface 42*f* side is lower than the fifth surface 42*e* side, and the circuit board 90 is located closer to the fifth surface 42*e* side than the inlet 67. According to this configuration, it is possible to suppress the waste liquid of waste liquid into the circuit board 90 when waste liquid is leaked from the inlet 67.

2. Second Exemplary Embodiment

Figure 8A:
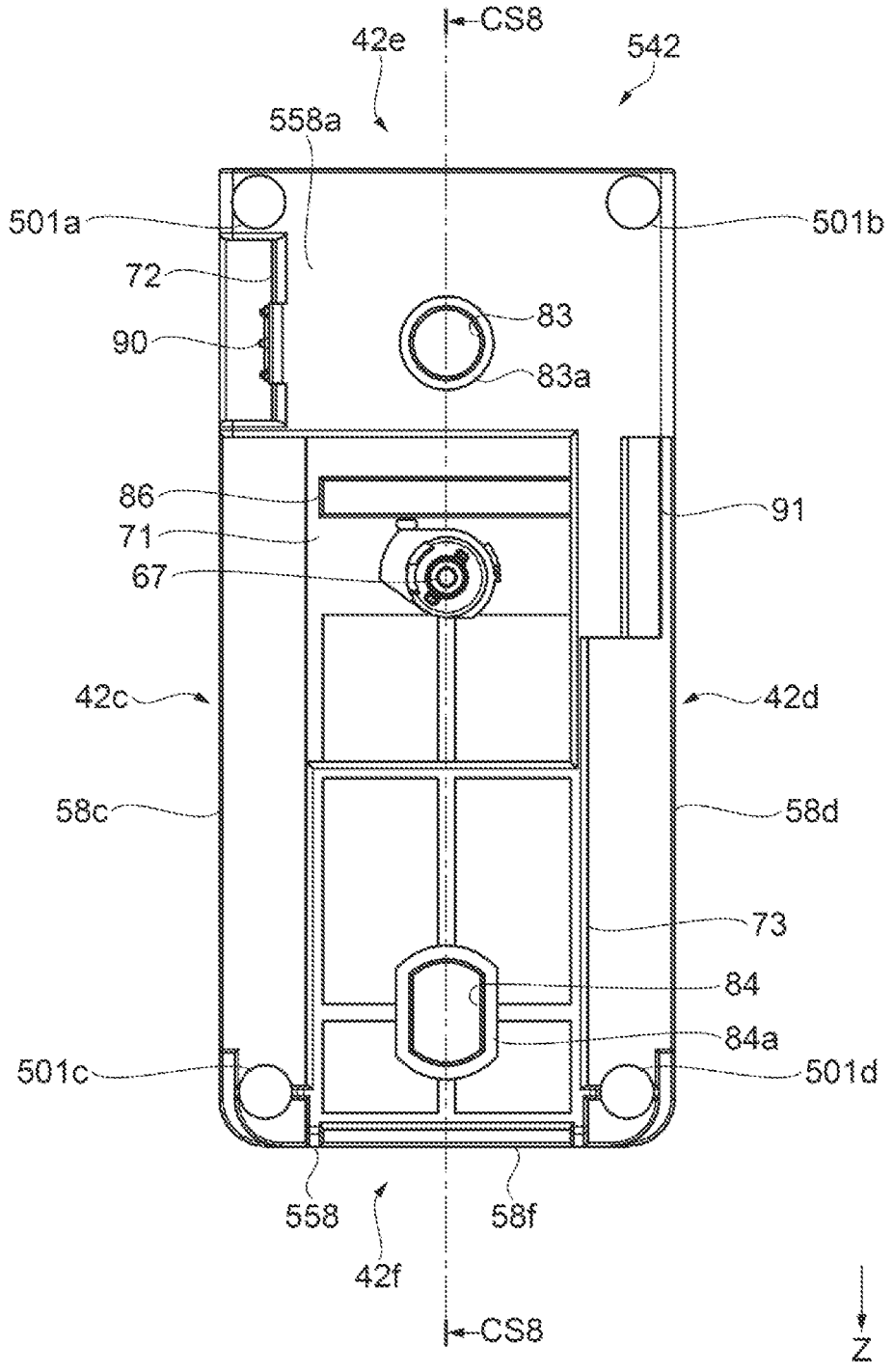
FIG. 8A is a side view of a waste liquid container according to a second exemplary embodiment in the mounting posture as viewed from the first surface side.
Figure 8B:
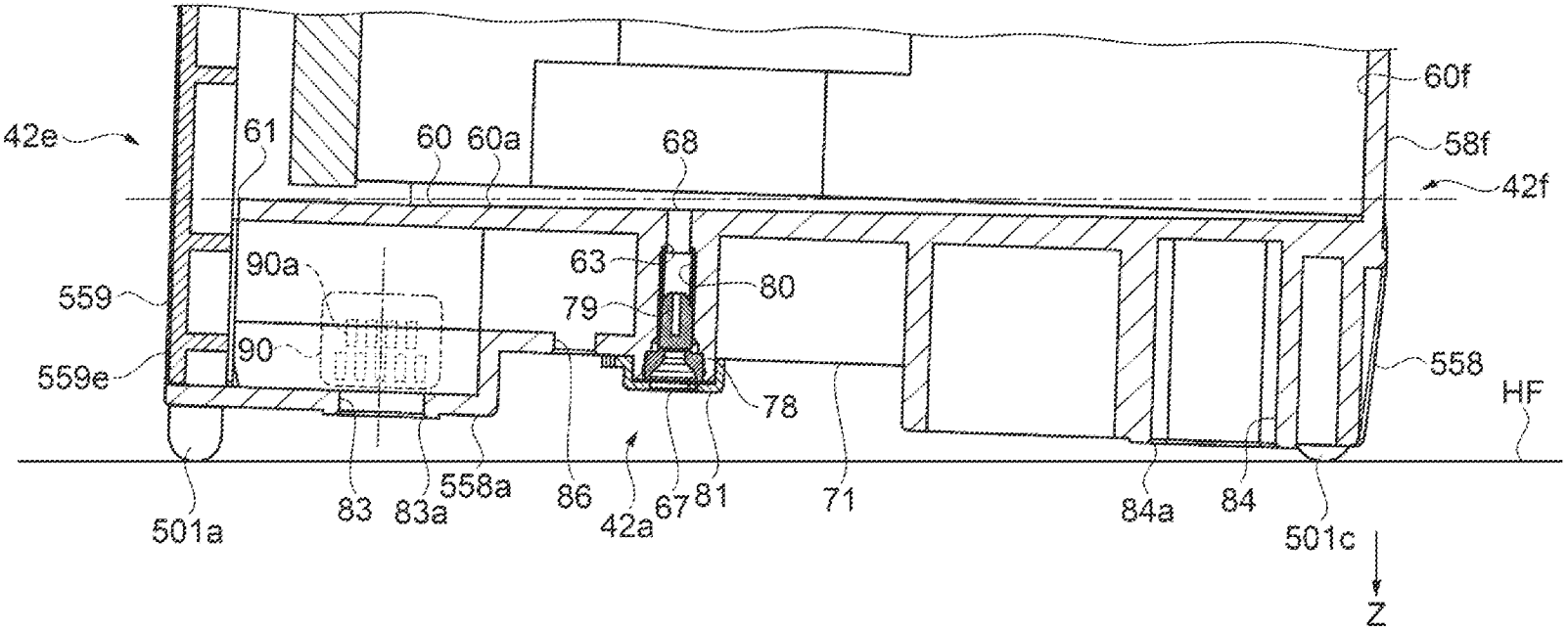
FIG. 8B is a partial cross-sectional view illustrating the waste liquid container according to the second exemplary embodiment in the placement state.

FIG. 8A is a side view of a waste liquid container 542 according to a second exemplary embodiment as viewed from the first surface 42*a* in the mounting posture A. FIG. 8B illustrates the placement state in which the waste liquid container 542 according to the second exemplary embodiment is placed at the horizontal plane HF with the first surface 42*a* facing downward, using a partial cross section enlarging the first surface 42*a* side of the waste liquid container 42 in the cross section along a line CS8-CS8 of FIG. 8A. The waste liquid container 542 of the present exemplary embodiment is formed by changing the accommodation container 58 and the cover 59 in the first exemplary embodiment to an accommodation container 558 and a cover 559. Note that the constituent parts as in the first exemplary embodiment are referenced using like numbers, and no detailed descriptions for such configurations are provided below.

The accommodation container 558 is formed by changing the first side wall 58*a* of the accommodation container 58 to a first side wall 558*a* illustrated in FIG. 8A. The first side wall 558*a* constituting the first surface 42*a* of the waste liquid container 542 includes a protrusion 501*a* to a protrusion 501*d* as contact portions. Additionally, the first side wall 558*a* does not include the insertion hole 85 provided at the first side wall 58*a* of the accommodation container 58.

As illustrated in FIG. 8B, the cover 559 does not include the protrusion 101 of the cover 59. Thus, as illustrated in FIG. 8B, a lid portion 559*e* of the cover 559 differs from the lid portion 59*e* of the cover 59 in the shape of the first surface 42*a* side in the mounting direction Y.

As illustrated in FIG. 8A, in the mounting posture A, the protrusion 501*a* and the protrusion 501*c* are located closer to the third surface 42*c* of the waste liquid container 542 than the center of the first side wall 558*a* in the lateral direction of the first side wall 558*a*. Additionally, in the mounting posture A, the protrusion 501*b* and the protrusion 501*d* are located closer to the fourth surface 42*d* of the waste liquid container 542 than the center of the first side wall 558*a* in the lateral direction of the first side wall 558*a*. In other words, in the mounting posture A of the waste liquid container 542 in the mounted state of being mounted in the mounting portion 43, the protrusion 501*a* to the protrusion 501*d* are provided at a plurality of locations sandwiching the center, in the lateral width direction, of the first surface 42*a* in the lateral width direction of the first side wall 558*a*.

As illustrated in FIG. 8A, the protrusions 501*a* and 501*b* are located closer to the fifth surface 42*e* serving as the upper surface in the mounting posture A than the sixth surface 42*f* serving as the bottom surface in the mounting posture A. Additionally, the protrusions 501*c* and the protrusions 501*d* are located closer to the sixth surface 42*f* serving as the bottom surface in the mounting posture A than the fifth surface 42*e* serving as the upper surface in the mounting posture A.

When the regulated portion 83*a* and the regulated portion 84*a* of the waste liquid container 542 are referred to as reference in the mounting direction Y, a protruding amount of the protrusion 501*a* in the mounting direction Y is greater than a protruding amount of the protrusion 501*c* in the mounting direction Y, as illustrated in FIG. 8B. At this time, a protruding amount of the protrusion 501*b* in the mounting direction Y is the same as the protruding amount of the protrusion 501*a* in the mounting direction Y, and a protruding amount of the protrusion 501*d* in the mounting direction Y is the same as the protruding amount of the protrusion 501*c* in the mounting direction Y.

As illustrated in FIG. 8B, in the placement state, the protrusion 501*a* to the protrusion 501*d* as the contact portions contact the horizontal plane HF, thereby setting the postures of the waste liquid container 542 and the accommodation chamber 60 included in the waste liquid container 542.

In the placement state, as can be seen from a comparison between the inner surface 60*a* and a two-dot chain line parallel to the horizontal plane HF illustrated in FIG. 8B, the inner surface 60*a* serving as the lower surface of the accommodation chamber 60 is in the inclined state where the sixth surface 42*f* side serving as the bottom surface in the mounting posture A is lower than the fifth surface 42*e* side serving as the upper surface in the mounting posture A. As described above, according to the present exemplary embodiment as well, in the placement state of being placed at the horizontal plane HF with the first surface 42*a* facing downward, the waste liquid container 542 is in the inclined state where the inner surface 60*f* side of the inner surface 60*a* serving as the lower surface of the accommodation chamber 60 is lower than the opening 61 side of the inner surface 60, thereby it is possible to prevent the waste liquid in the accommodation chamber 60 from flowing toward the opening 61 and leaking out of the waste liquid container 542.

As described above, according to the second exemplary embodiment, the following effects can be obtained.

The protrusion 501*a* to the protrusion 501*d* included in the waste liquid container 542 are provided at a plurality of locations in the lateral width direction the center in the lateral direction of the first surface 42*a* in the mounted state. According to this configuration, when the first surface 42*a* of the waste liquid container 542 is placed facing downward, the posture of the waste liquid container 542 can be stabilized.

3. Third Exemplary Embodiment

Figure 9A:
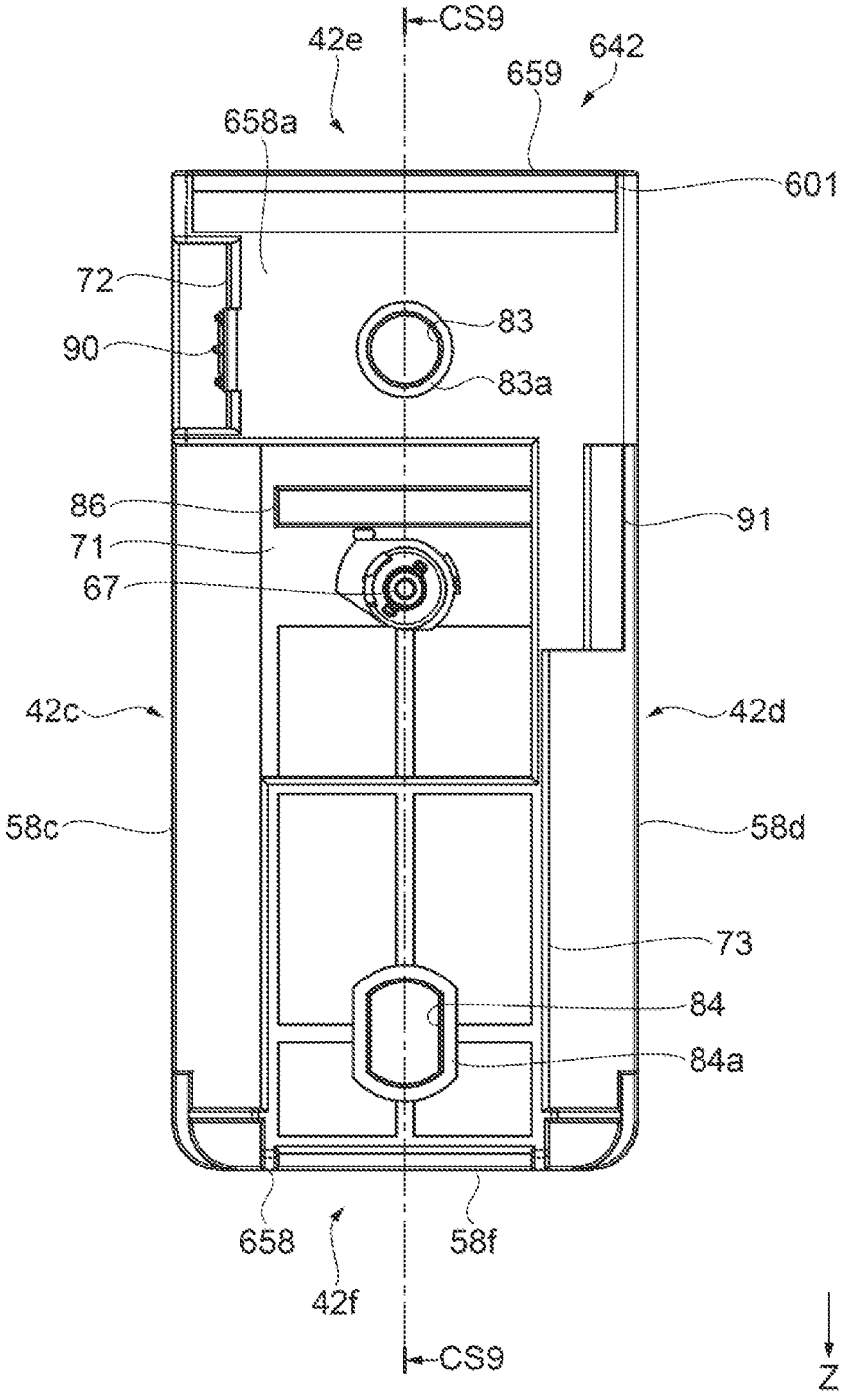
FIG. 9A is a side view of a waste liquid container according to a third exemplary embodiment in the mounting posture as viewed from the first surface side.
Figure 9B:
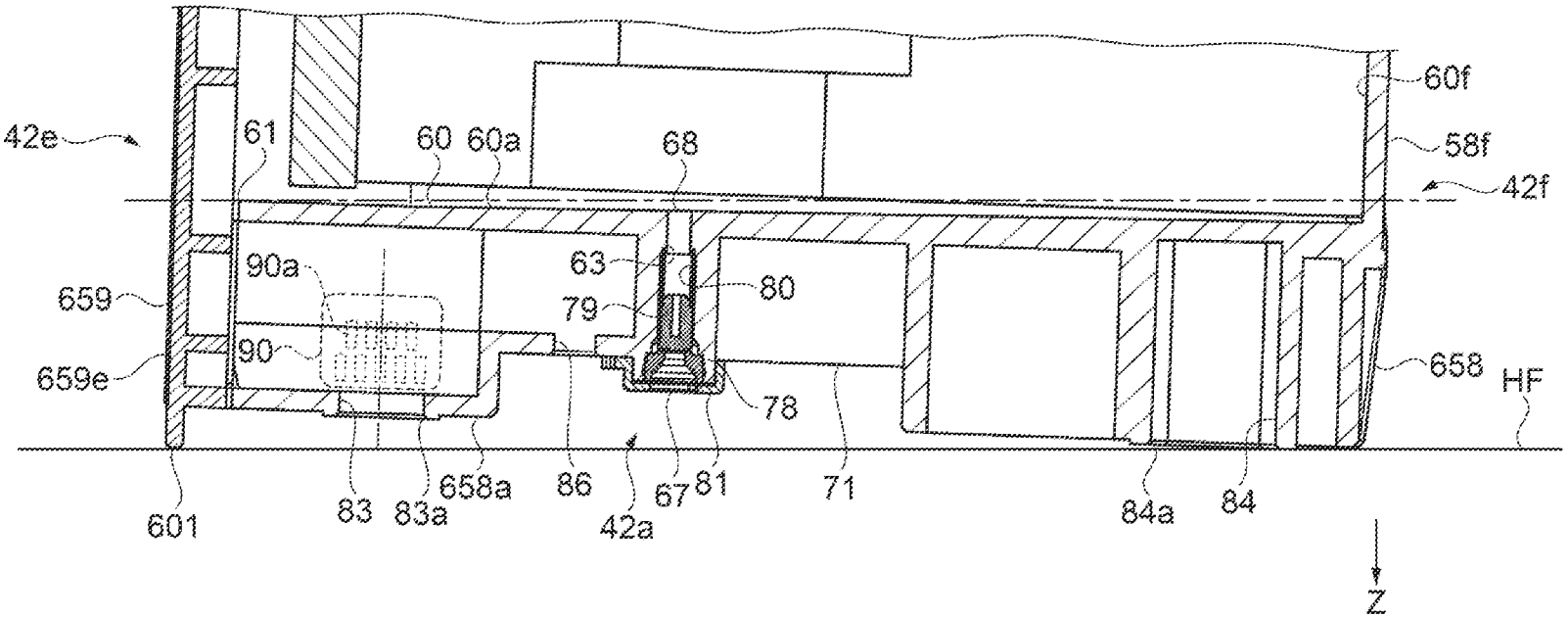
FIG. 9B is a partial cross-sectional view illustrating the waste liquid container according to the third exemplary embodiment in the placement state.

FIG. 9A is a side view of a waste liquid container 642 according to a three exemplary embodiment as viewed from the first surface 42*a* in the mounting posture A. FIG. 9B illustrates the placement state in which the waste liquid container 642 according to the third exemplary embodiment is placed at the horizontal plane HF with the first surface 42*a* facing downward, using a partial cross section enlarging the first surface 42*a* side of the waste liquid container 642 in the cross section along a line CS9-CS9 of FIG. 9A. The waste liquid container 642 of the present exemplary embodiment is formed by changing the accommodation container 58 and the cover 59 in the first exemplary embodiment to an accommodation container 658 and a cover 659. Note that the constituent parts as in the first exemplary embodiment are referenced using like numbers, and no detailed descriptions for such configurations are provided below.

The accommodation container 658 is formed by changing the first side wall 58*a* of the accommodation container 58 to a first side wall 658*a* illustrated in FIG. 9A. The first side wall 658*a* that constitutes the first surface 42*a* of the waste liquid container 642 does not include the insertion hole 85 provided at the first side wall 58*a* of the accommodation container 58.

As illustrated in FIGS. 9A and 9B, a protrusion 601 included in the cover 659 is integrally provided with a lid portion 659*e* of the cover 659. The position of the protrusion 601 is different from the protrusion 101 of the cover 59. Thus, as illustrated in FIGS. 9A and 9B, the lid portion 659*e* differs from the lid portion 59*e* of the cover 59 in the shape of the first surface 42*a* side in the mounting direction Y. As a result, in the present exemplary embodiment, the lid portion 659*e* of the cover 659 constitutes a portion of the first surface 42*a* of the waste liquid container 642. In addition, the protrusion 601 in the present exemplary embodiment does not pass through the first side wall 658*a* that constitutes the first surface 42*a* of the waste liquid container 642.

As illustrated in FIG. 9A, in the mounting posture A, the protrusion 601 extends across the center of the first side wall 658*a* in the lateral direction of the first side wall 658*a*. In other words, in the mounting posture A of the waste liquid container 642 in the mounted state of being mounted in the mounting portion 43, the protrusion 601 extends across the center of the first surface 42*a* in the lateral width direction of the first surface 42*a* of the waste liquid container 642.

As illustrated in FIGS. 9A and 9B, the protrusion 601 is located closer to the fifth surface 42*e* side serving as the upper surface in the mounting posture A than the sixth surface 42*f* serving as the bottom surface in the mounting posture A.

As illustrated in FIG. 9B, in the placement state, the protrusion 601 and the regulated portion 84*a* as the contact portions contact the horizontal plane HF, thereby setting the postures of the waste liquid container 642 and the accommodation chamber 60 included in the waste liquid container 642.

In the placement state, as can be seen from a comparison between the inner surface 60*a* and a two-dot chain line parallel to the horizontal plane HF illustrated in FIG. 9B, the inner surface 60*a* serving as the lower surface of the accommodation chamber 60 is in the inclined state where the sixth surface 42*f* side serving as the bottom surface in the mounting posture A is lower than the fifth surface 42*e* side serving as the upper surface in the mounting posture A. As described above, according to the present exemplary embodiment as well, in the placement state of being placed at the horizontal plane HF with the first surface 42*a* facing downward, the waste liquid container 642 is in the inclined state where the inner surface 60*f* side of the inner surface 60*a* serving as the lower surface of the accommodation chamber 60 is lower than the opening 61 side of the inner surface 60, thereby it is possible to prevent the waste liquid in the accommodation chamber 60 from flowing toward the opening 61 and leaking out of the waste liquid container 642.

4. Fourth Exemplary Embodiment

Figure 10A:
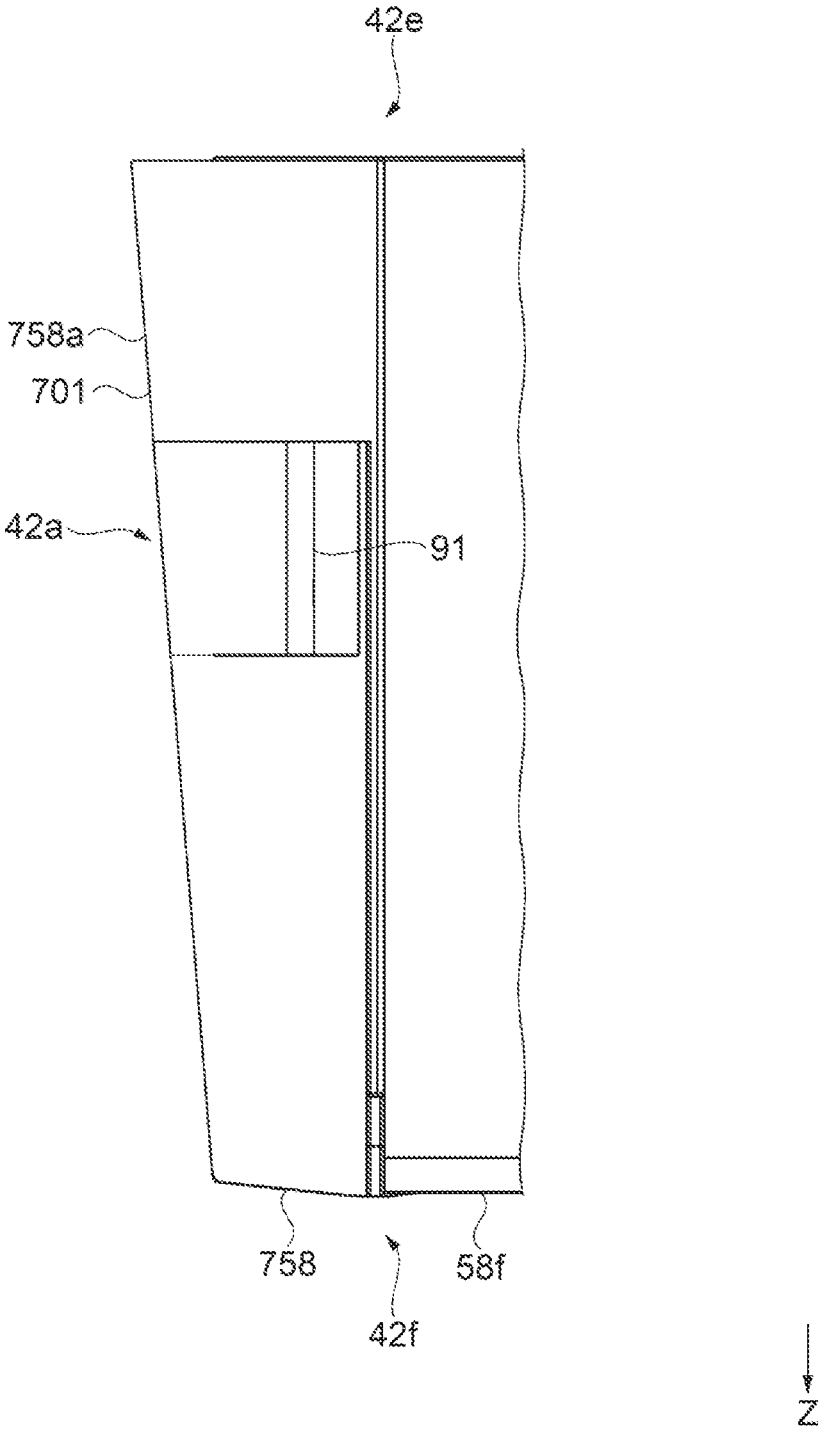
FIG. 10A is a side view of a waste liquid container according to a fourth exemplary embodiment in the mounting posture as viewed from the fourth surface side.
Figure 10B:
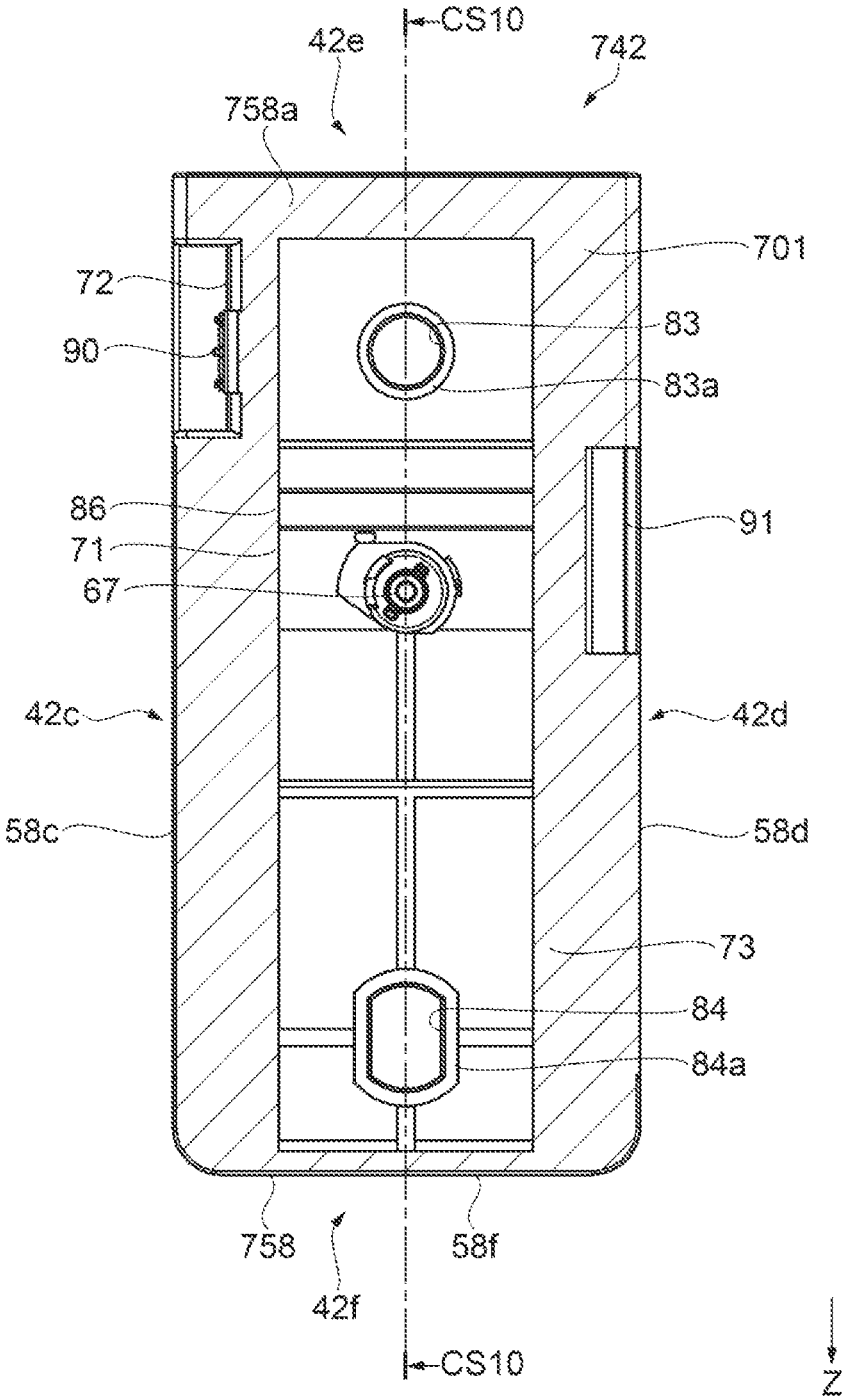
FIG. 10B is a side view of the waste liquid container according to the fourth exemplary embodiment in the mounting posture as viewed from the first surface side.
Figure 10C:
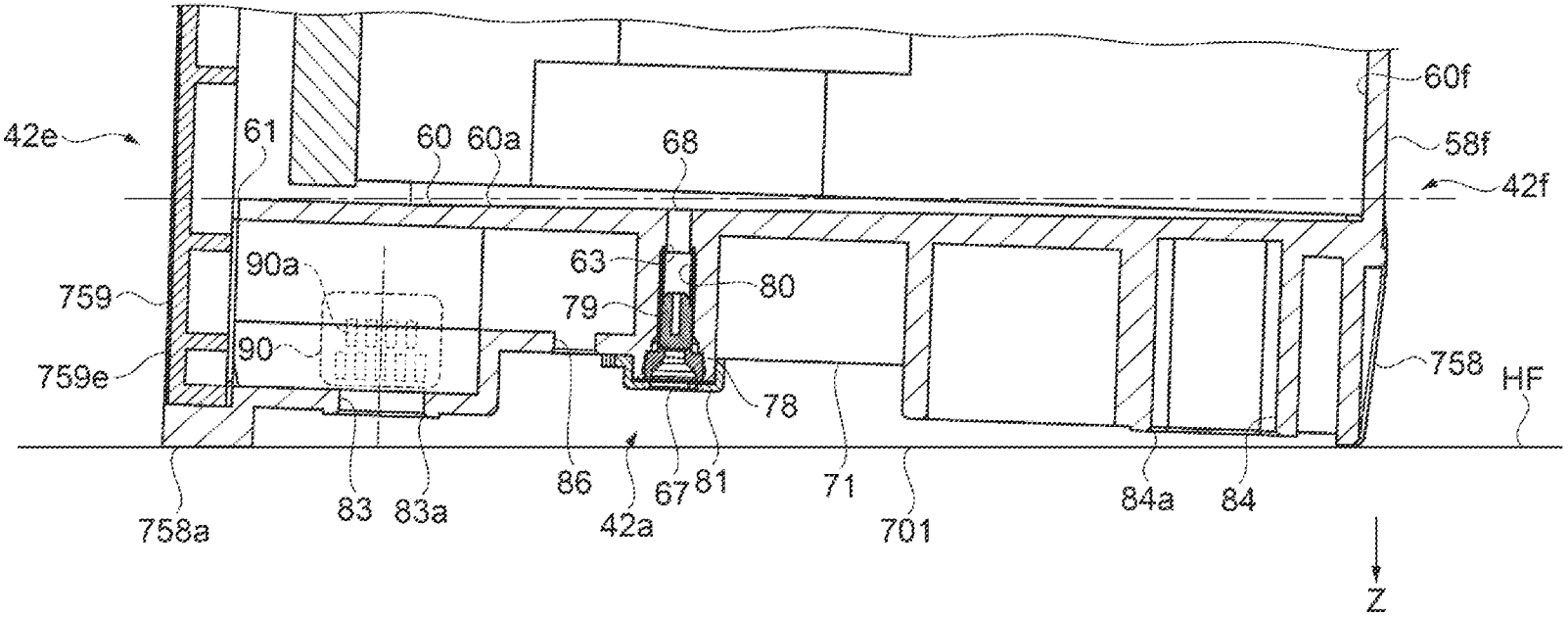
FIG. 10C is a partial cross-sectional view illustrating the waste liquid container according to the fourth exemplary embodiment in the placement state.

FIG. 10A is a side view of a waste liquid container 742 according to a fourth exemplary embodiment as viewed from the fourth surface 42*d* side in the mounting posture A. FIG. 10B is a side view of the waste liquid container 742 according to the fourth exemplary embodiment as viewed from the first surface 42*a* side in the mounting posture A. FIG. 10C illustrates the placement state in which the waste liquid container 742 according to the fourth exemplary embodiment is placed at the horizontal plane HF with the first surface 42*a* facing downward, using a partial cross section enlarging the first surface 42*a* side of the waste liquid container 742 in the cross section along a line CS10-CS10 of FIG. 10A. The waste liquid container 742 of the present exemplary embodiment is formed by changing the accommodation container 58 and the cover 59 in the first exemplary embodiment to an accommodation container 758 and a cover 759. Note that the constituent parts as in the first exemplary embodiment are referenced using like numbers, and no detailed descriptions for such configurations are provided below.

The accommodation container 758 is formed by changing the first side wall 58*a* of the accommodation container 58 to a first side wall 758*a* illustrated in FIGS. 10A to 10C. As illustrated in FIGS. 10A to 10C, a contact surface 701 is provided at the first side wall 758*a* constituting the first surface 42*a* of the waste liquid container 742. In FIG. 10B, a hatched portion is the contact surface 701. The contact surface 701 is provided at the first side wall 758*a* so that the regulated portion 83*a*, the recessed portion 71 provided with the inlet 67, and the regulated portion 84*a* are surround. Additionally, the first side wall 758*a* does not include the insertion hole 85 provided at the first side wall 58*a* of the accommodation container 58.

As illustrated in FIG. 10C, the cover 759 does not include the protrusion 101 included in the cover 59. Thus, as illustrated in FIG. 10C, a lid portion 759*e* of the cover 759 differs from the lid portion 59*e* of the cover 59 in the shape of the first surface 42*a* side in the mounting direction Y.

As illustrated in FIG. 10C, in the placement state, the contact surface 701 as the contact portion contacts the horizontal plane HF, thereby setting the postures of the waste liquid container 742 and the accommodation chamber 60 included in the waste liquid container 742.

In the placement state, as can be seen from a comparison between the inner surface 60*a* and a two-dot chain line parallel to the horizontal plane HF illustrated in FIG. 10C, the inner surface 60*a* serving as the lower surface of the accommodation chamber 60 is in the inclined state where the sixth surface 42*f* side serving as the bottom surface in the mounting posture A is lower than the fifth surface 42*e* side serving as the upper surface in the mounting posture A. As described above, according to the present exemplary embodiment as well, in the placement state of being placed at the horizontal plane HF with the first surface 42*a* facing downward, the waste liquid container 742 is in the inclined state where the inner surface 60*f* side of the inner surface 60*a* serving as the lower surface of the accommodation chamber 60 is lower than the opening 61 side of the inner surface 60, thereby it is possible to prevent the waste liquid in the accommodation chamber 60 from flowing toward the opening 61 and leaking out of the waste liquid container 742.

5. Fifth Exemplary Embodiment

Figure 11A:
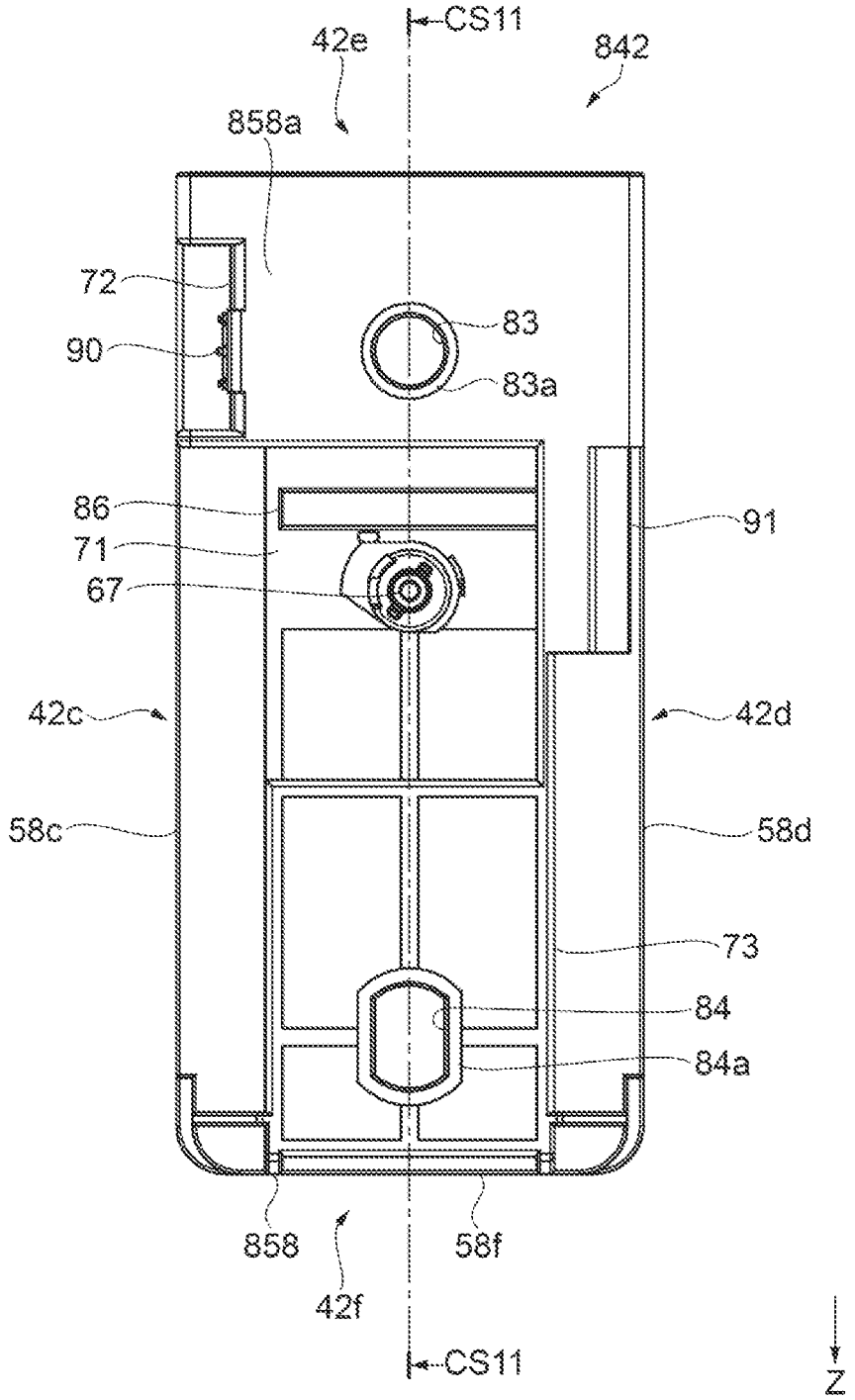
FIG. 11A is a side view of a waste liquid container according to a fifth exemplary embodiment in the mounting posture as viewed from the first surface side.
Figure 11B:
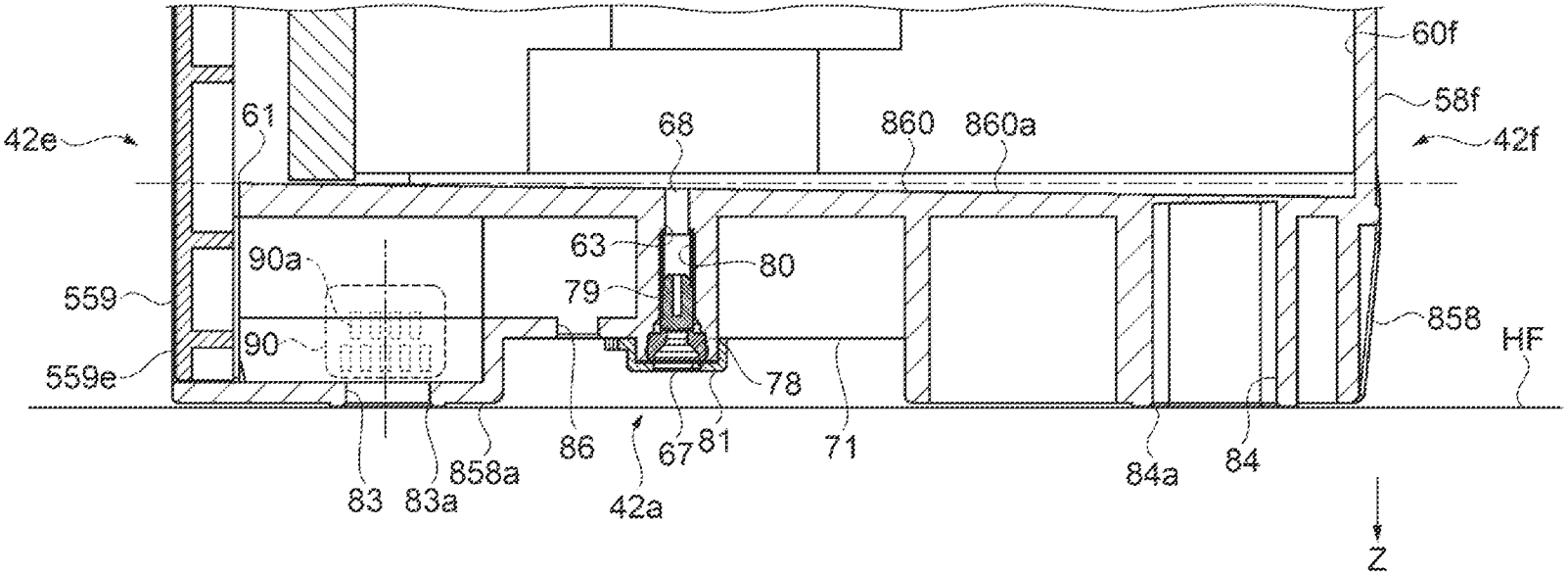
FIG. 11B is a partial cross-sectional view illustrating the waste liquid container according to the fifth exemplary embodiment in the placement state.

FIG. 11A is a side view of the waste liquid container 842 according to a fifth exemplary embodiment as viewed from the first surface 42*a* side in the mounting posture A. FIG. 11B illustrates the placement state in which the waste liquid container 842 according to the fifth exemplary embodiment is placed at the horizontal plane HF with the first surface 42*a* facing downward, using a partial cross section enlarging the first surface 42*a* side of the waste liquid container 842 in the cross section along a line CS11-CS11 of FIG. 11A. The waste liquid container 842 of the present exemplary embodiment is formed by changing the accommodation container 58, the accommodation chamber 60, and the cover 59 in the first exemplary embodiment to an accommodation container 858, an accommodation chamber 860, and the cover 559 in the second exemplary embodiment. Note that the constituent parts as in the first exemplary embodiment and the second exemplary embodiment are referenced using like numbers, and no detailed descriptions for such configurations are provided below.

The accommodation container 858 is formed by changing the first side wall 58*a* of the accommodation container 58 to the first side wall 858*a* illustrated in FIGS. 11A and 11B. The first side wall 858*a* that constitutes the first surface 42*a* of the waste liquid container 842 does not include the insertion hole 85 provided at the first side wall 58*a* of the accommodation container 58.

As illustrated in FIG. 11B, in the accommodation chamber 860, the inner surface 60*a* of the accommodation chamber 60 is changed to the inner surface 860*a*.

As illustrated in FIG. 11B, in the placement state, the regulated portion 83*a* and the regulated portion 84*a* contact the horizontal plane HF as the contact portions, thereby setting the postures of the waste liquid container 842 and the accommodation chamber 860 included in the waste liquid container 842.

In the placement state, as can be seen from a comparison between the inner surface 860*a* and a two-dot chain line parallel to the horizontal plane HF illustrated in FIG. 11C in the placement state, the inner surface 860*a* serving as the lower surface of the accommodation chamber 860 is formed to be in the inclined state where the sixth surface 42*f* side serving as the bottom surface in the mounting posture A is lower than the fifth surface 42*e* side serving as the upper surface in the mounting posture A. As described above, according to the present exemplary embodiment as well, in the placement state of being placed at the horizontal plane HF with the first surface 42*a* facing downward, the waste liquid container 842 is in the inclined state where the inner surface 60*f* side of the inner surface 860*a* serving as the lower surface of the accommodation chamber 860 is lower than the opening 61 side of the inner surface 860*a*, thereby it is possible to prevent the waste liquid in the accommodation chamber 860 from flowing toward the opening 61 and leaking out of the waste liquid container 842.

The above exemplary embodiments and the other exemplary embodiments described below can be implemented in combination with each other to the extent that they are technically consistent. Hereinafter, other exemplary embodiments will be described.

In the first exemplary embodiment, a waste liquid introduction portion included in the waste liquid container 42 may be provided at a surface different from the first surface 42*a* serving as a front surface in the mounting direction when the waste liquid container 42 is mounted in the mounting portion 43. For example, in the mounted state where the waste liquid container 42 is mounted in the mounting portion 43, an opening as the waste liquid introduction portion may be provided at the lid portion 59*e* of the cover 59 constituting the upper surface of the waste liquid container 42, and then the waste liquid discharged from the discharge tube 49 of the mounting portion 43 arranged vertically above the opening may be accommodated in the accommodation chamber 60 via the opening of the lid portion 59*e*.

In second exemplary embodiment, the waste liquid introduction portion included in the waste liquid container 542 may contact the horizontal plane HF in the placement state where the first surface 42*a* of the waste liquid container 542 is placed in the horizontal plane HF facing downward, where the waste liquid introduction portion is provided at the waste liquid container 542. For example, the inlet 67 included in the first surface 42*a* of the waste liquid container 542 may be provided at a position in which the inlet 67 is in contact with the horizontal plane HF in the placement state.

In the fourth exemplary embodiment, the circuit board 90 included in the waste liquid container 742 may be provided at a position closer to the bottom surface than the upper surface of the waste liquid container 742 in the mounted state where the waste liquid container 742 is mounted in the mounting portion 43. For example, the circuit board 90 included in the waste liquid container 742 may be provided closer to the sixth surface 42*f* side of the waste liquid container 842 than the inlet 67.

In the first exemplary embodiment, the circuit board 90 included in the waste liquid container 42 need not be provided at the third surface 42*c*. For example, the circuit board 90 may be provided at the lid portion 59*e* of the cover 59 that constitutes the fifth surface 42*e* of the waste liquid container 42.

In the first exemplary embodiment, the waste liquid container 42 need not include the circuit board 90.

In the first exemplary embodiment, the accommodation chamber 60 included in the waste liquid container 42 may be provided at another member accommodated in the accommodation container 58. In this case, the sealing member 78, the valve body 79, and the pressing member 80 may be provided at the waste fluid flow path 63 formed at another member.

In the second exemplary embodiment, the waste liquid container 542 may not include the cover 559. In this case, the movement of the absorbent body 64 out of the accommodation chamber 60 may be regulated by providing a fixing finger that fixes the absorbent body 64*b* to a position closer to the fifth surface 42*e* side of the absorbent body 64*b* than the accommodation chamber 60. Alternatively, by making the outer shape of the absorbent body 64*b* greater than the opening 61, the movement of the absorbent body 64 out of the accommodation chamber 60 may be suppressed.

What is claimed is:

1. A waste liquid container including a bottom surface, an upper surface, and a plurality of side surfaces that intersect with the bottom surface and the upper surface, the waste liquid container detachably mounted in a mounting portion including a discharge portion configured to discharge liquid with the bottom surface facing downward, the waste liquid container comprising:

an accommodation chamber including an opening that is open upward of the waste liquid container in a mounted state where the waste liquid container is mounted in the mounting portion, the accommodation chamber being configured to accommodate the liquid; and a contact portion provided at a first surface of the plurality of side surfaces, of the waste liquid container in the mounted state, wherein in a placement state where the waste liquid container is placed at a horizontal plane with the first surface facing downward, the contact portion is configured to contact a horizontal plane and set a posture of the accommodation chamber with respect to the horizontal plane, and in the placement state, an inner surface serving as a lower surface of the accommodation chamber is in an inclined state where the bottom surface of the waste liquid container is lower than the upper surface of the waste liquid container.

2. The waste liquid container according to claim 1, wherein the contact portion includes at least one protrusion provided at the first surface.

3. The waste liquid container according to claim 2, wherein the at least one protrusion is provided at a plurality of locations sandwiching a center in a lateral direction of the first surface in the mounted state.

4. The waste liquid container according to claim 2, wherein the at least one protrusion extends across a center in a lateral direction of the first surface in the mounted state.

5. The waste liquid container according to claim 2, wherein the at least one protrusion is located closer to the upper surface than to the bottom surface.

6. The waste liquid container according to claim 2, comprising a cover configured to constitute the upper surface of the waste liquid container, and cover the opening of the accommodation chamber, wherein the at least one protrusion is integrally formed with the cover.

7. The waste liquid container according to claim 6, wherein the at least one protrusion is formed at the first surface by a portion of the cover extending through the first surface.

8. The waste liquid container according to claim 1, wherein a waste liquid introduction portion, into which the liquid discharged from the discharge portion is introduced, is provided at the first surface serving as a front surface in a mounting direction when the waste liquid container is mounted in the mounting portion.

9. The waste liquid container according to claim 8, wherein the waste liquid introduction portion is separated from the horizontal plane in the placement state.

10. The waste liquid container according to claim 8, further comprising a circuit board including a coupling terminal configured to be electrically coupled to a mounting portion side coupling terminal provided at the mounting portion, wherein in the placement state, the first surface is in the inclined state where the bottom surface is lower than the upper surface, and the circuit board is located on the side of the upper surface with respect to the waste liquid introduction portion.

* * * * *